US011548280B2

(12) United States Patent
Fukuzawa et al.

(10) Patent No.: US 11,548,280 B2
(45) Date of Patent: Jan. 10, 2023

(54) LIQUID EJECTING HEAD AND LIQUID EJECTING SYSTEM

(71) Applicant: SEIKO EPSON CORPORATION, Tokyo (JP)

(72) Inventors: Yuma Fukuzawa, Matsumoto (JP); Shotaro Tamai, Matsumoto (JP); Yoichi Naganuma, Matsumoto (JP); Akira Miyagishi, Matsumoto (JP); Kazuaki Uchida, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/108,702

(22) Filed: Dec. 1, 2020

(65) Prior Publication Data

US 2021/0162758 A1 Jun. 3, 2021

(30) Foreign Application Priority Data

Dec. 3, 2019 (JP) ..... JP2019-218630

(51) Int. Cl.
*B41J 2/14* (2006.01)

(52) U.S. Cl.
CPC ..... *B41J 2/1433* (2013.01); *B41J 2/14201* (2013.01); *B41J 2002/14419* (2013.01)

(58) Field of Classification Search
CPC ..... B41J 2/1433; B41J 2/14201; B41J 2002/14419; B41J 2002/14241; B41J 2002/14411; B41J 2/14233; B41J 2002/14491; B41J 2202/11; B41J 2202/12; B41J 2/01
See application file for complete search history.

(56) References Cited

U.S. PATENT DOCUMENTS

| | | | |
|---|---|---|---|
| 4,835,554 | A | 5/1989 | Hoisington et al. |
| 4,891,654 | A | 1/1990 | Hoisington et al. |
| 5,714,078 | A | 2/1998 | Thiel |
| 5,802,687 | A | 9/1998 | Thiel et al. |
| 6,070,972 | A | 6/2000 | Thiel |
| 2004/0036001 | A1 | 2/2004 | Barfield |
| 2008/0225085 | A1 | 9/2008 | Suzuki |
| 2010/0214380 | A1 | 8/2010 | Essen et al. |
| 2013/0233939 | A1 | 9/2013 | Uezawa |
| 2017/0239946 | A1 | 8/2017 | Nakagawa |
| 2019/0366714 | A1 | 12/2019 | Tsukahara et al. |

(Continued)

FOREIGN PATENT DOCUMENTS

| | | |
|---|---|---|
| DE | 3710654 | 10/1988 |
| EP | 2829404 | 1/2015 |
| EP | 3543025 | 9/2019 |

(Continued)

OTHER PUBLICATIONS

IP.com search (Year: 2022).*

*Primary Examiner* — Lisa Solomon
(74) *Attorney, Agent, or Firm* — Workman Nydegger

(57) ABSTRACT

A liquid ejecting head including: an individual flow path row in which a plurality of individual flow paths communicating with a nozzle that ejects a liquid in a first axis direction are arranged in parallel along a second axis orthogonal to a first axis, and a first common liquid chamber communicating with the plurality of individual flow paths, in which each of the plurality of individual flow paths has a pressure chamber that stores a liquid.

14 Claims, 18 Drawing Sheets

(56) References Cited

U.S. PATENT DOCUMENTS

| | | | |
|---|---|---|---|
| 2019/0366717 | A1 | 12/2019 | Tsukahara et al. |
| 2020/0198343 | A1 | 6/2020 | Fukuzawa |

FOREIGN PATENT DOCUMENTS

| | | |
|---|---|---|
| JP | 1990-500732 | 3/1990 |
| JP | H02-500584 | 3/1990 |
| JP | 2013-184372 | 9/2013 |
| JP | 2017-144699 | 8/2017 |
| JP | 2018-103602 | 7/2018 |
| JP | 2020-100135 | 7/2020 |

* cited by examiner

LIQUID EJECTING HEAD AND LIQUID EJECTING SYSTEM

The present application is based on, and claims priority from JP Application Serial Number 2019-218630, filed Dec. 3, 2019, the disclosure of which is hereby incorporated by reference herein in its entirety.

BACKGROUND

1. Technical Field

The present disclosure relates to a liquid ejecting head and a liquid ejecting system.

2. Related Art

For example, a liquid ejecting head that ejects a liquid such as ink from a plurality of nozzles has been proposed from the past. For example, JP-A-2013-184372 discloses a liquid ejecting head that ejects a liquid from a nozzle communicating with a pressure chamber by varying a pressure of a liquid in the pressure chamber using a piezoelectric element.

In recent liquid ejecting heads, it is required to dispose a large number of nozzles at a high density. In order to dispose a large number of nozzles at a high density, it is necessary to efficiently dispose a flow path including a pressure chamber. In the liquid ejecting heads in the related art, there is room for further improvement in terms of efficient disposition of a large number of flow paths.

SUMMARY

According to a first aspect of the present disclosure, there is provided a liquid ejecting head including: a plurality of individual flow paths, each of which has a pressure chamber and communicates with a nozzle that ejects a liquid in a first axis direction; and a first common liquid chamber coupled to the plurality of individual flow paths, in which when viewed in the first axis direction, the plurality of individual flow paths are arranged in parallel along a second axis direction orthogonal to a first axis to form an individual flow path row, when two individual flow paths adjacent to each other in the individual flow path row are assumed to be a first individual flow path and a second individual flow path, the first individual flow path includes a first local flow path that causes the pressure chamber and the nozzle to communicate with each other, and the first local flow path does not overlap the second individual flow path when viewed in the second axis direction.

According to a second aspect of the present disclosure, there is provided a liquid ejecting head including: a plurality of individual flow paths, each of which has a pressure chamber and communicates with a nozzle that ejects a liquid in a first axis direction; and a first common liquid chamber coupled to the plurality of individual flow paths, in which when viewed in the first axis direction, the plurality of individual flow paths are arranged in parallel along a second axis direction orthogonal to a first axis to form an individual flow path row, and when two individual flow paths adjacent to each other in the individual flow path row are assumed to be a first individual flow path and a second individual flow path, the first individual flow path includes a fifth local flow path that overlaps the nozzle communicating with the second individual flow path when viewed in the second axis direction.

According to a third aspect of the present disclosure, there is provided a liquid ejecting head including: a plurality of individual flow paths, each of which has a pressure chamber and communicates with a nozzle that ejects a liquid in a first axis direction, and a first common liquid chamber coupled to the plurality of individual flow paths, in which when viewed in the first axis direction, the plurality of individual flow paths are arranged in parallel along a second axis direction orthogonal to a first axis to form an individual flow path row, and when two individual flow paths adjacent to each other in the individual flow path row are assumed to be a first individual flow path and a second individual flow path, the first individual flow path includes a first partial flow path, and the second individual flow path includes a second partial flow path, the first partial flow path includes a seventh local flow path and an eighth local flow path that extend in a direction orthogonal to the first axis, and a ninth local flow path that causes the seventh local flow path and the eighth local flow path to communicate with each other, the seventh local flow path is in a layer closer to an ejecting surface of the nozzle than the eighth local flow path, and the second partial flow path includes a tenth local flow path and an eleventh local flow path that extend in a direction orthogonal to the first axis, and a twelfth local flow path that causes the tenth local flow path and the eleventh local flow path to communicate with each other, the tenth local flow path is in a layer closer to the ejecting surface of the nozzle than the eleventh local flow path, and at least portions of the first partial flow path and the second partial flow path do not overlap when viewed in the second axis direction.

According to a fourth aspect of the present disclosure, there is provided a liquid ejecting head including: a plurality of individual flow paths, each of which has a pressure chamber and communicates with a nozzle that ejects a liquid in a first axis direction, and a first common liquid chamber coupled to the plurality of individual flow paths, in which when viewed in the first axis direction, the plurality of individual flow paths are arranged in parallel along a second axis direction orthogonal to a first axis to form an individual flow path row, and when two individual flow paths adjacent to each other in the individual flow path row are assumed to be a first individual flow path and a second individual flow path, the first individual flow path includes a thirteenth local flow path that partially overlaps the second individual flow path when viewed in the first axis direction.

DESCRIPTION OF EXEMPLARY EMBODIMENTS

A: First Embodiment

Figure 1:
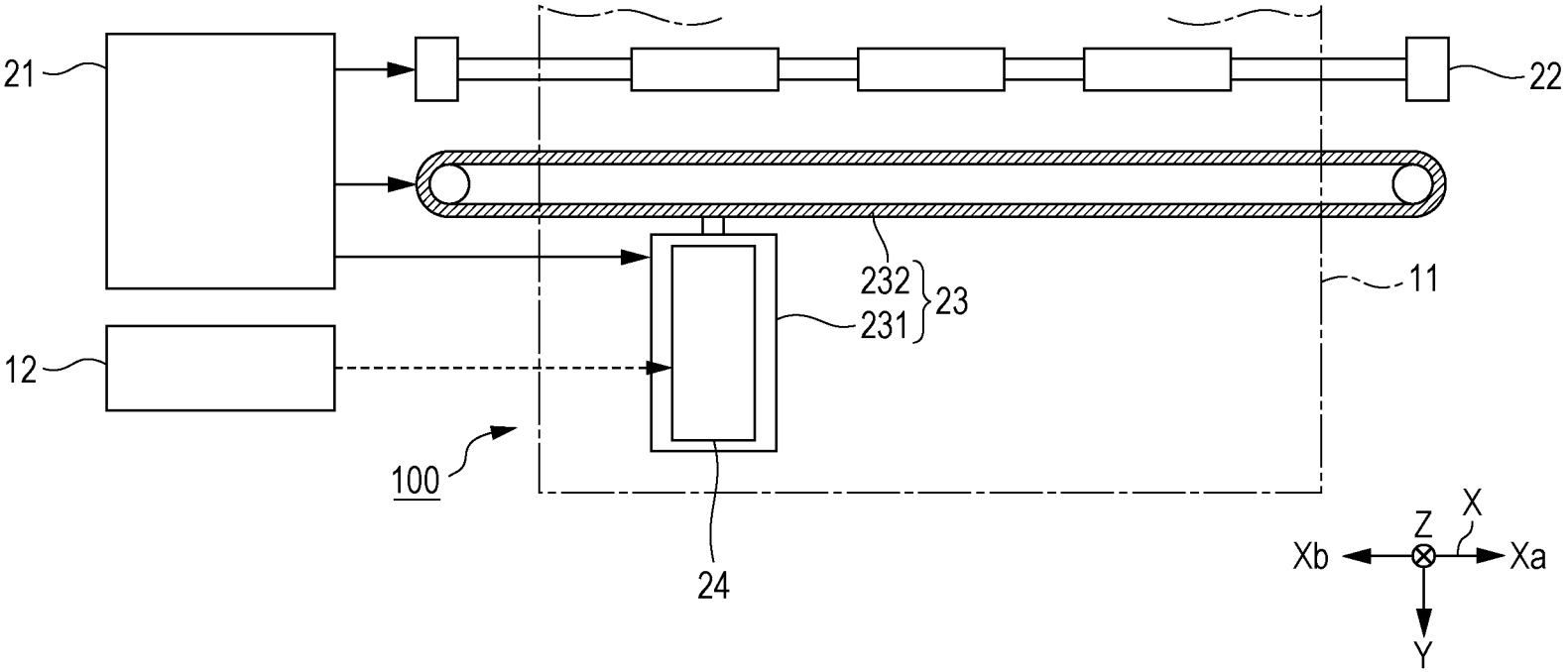
FIG. 1 is a block diagram illustrating a configuration of a liquid ejecting system according to a first embodiment.

As illustrated in FIG. 1, in the following description, an X axis, a Y axis, and a Z axis that are orthogonal to each other are assumed. One direction along the X axis when viewed from an optional point is referred to as an Xa direction, and a direction opposite to the Xa direction is referred to as an Xb direction. An X-Y plane including the X axis and the Y axis corresponds to a horizontal plane. The Z axis is an axis line along a vertical direction, and a positive direction of the Z axis corresponds to a lower side in the vertical direction.

FIG. 1 is a configuration diagram illustrating a partial configuration of a liquid ejecting system 100 according to a first embodiment. The liquid ejecting system 100 according to the first embodiment is an ink jet type printer that ejects droplets of ink, which is an example of a liquid, onto a medium 11. The medium 11 is, for example, printing paper. Note that, a print target of an optional material such as a resin film or a cloth is also used as the medium 11.

A liquid container 12 is installed in the liquid ejecting system 100. The liquid container 12 stores ink. For example, a cartridge that is attachable to and detachable from the liquid ejecting system 100, a bag-shaped ink pack formed of a flexible film, or an ink tank that can be supplemented with ink is used as the liquid container 12. The number of types of ink stored in the liquid container 12 is optional.

As illustrated in FIG. 1, the liquid ejecting system 100 includes a control unit 21, a transport mechanism 22, a moving mechanism 23, and a liquid ejecting head 24. The control unit 21 includes, for example, a processing circuit such as a central processing unit (CPU) and a field programmable gate array (FPGA), and a storage circuit such as a semiconductor memory, and controls respective elements of the liquid ejecting system 100.

The transport mechanism 22 transports the medium 11 along the Y axis under the control of the control unit 21. The moving mechanism 23 causes the liquid ejecting head 24 to reciprocate along the X axis under the control of the control unit 21. The moving mechanism 23 of the first embodiment includes a substantially box-shaped transport body 231 that houses the liquid ejecting head 24, and an endless transport belt 232 to which the transport body 231 is fixed. Note that, a configuration in which a plurality of liquid ejecting heads 24 are mounted on the transport body 231 or a configuration in which the liquid container 12 is mounted on the transport body 231 together with the liquid ejecting head 24 can also be adopted.

The liquid ejecting head 24 ejects ink that is supplied from the liquid container 12 from each of a plurality of nozzles onto the medium 11 under the control of the control unit 21. An image is formed on a surface of the medium 11 by the liquid ejecting head 24 ejecting ink onto the medium 11 in parallel with the transport of the medium 11 by the transport mechanism 22 and the repeated reciprocation of the transport body 231.

Figure 2:
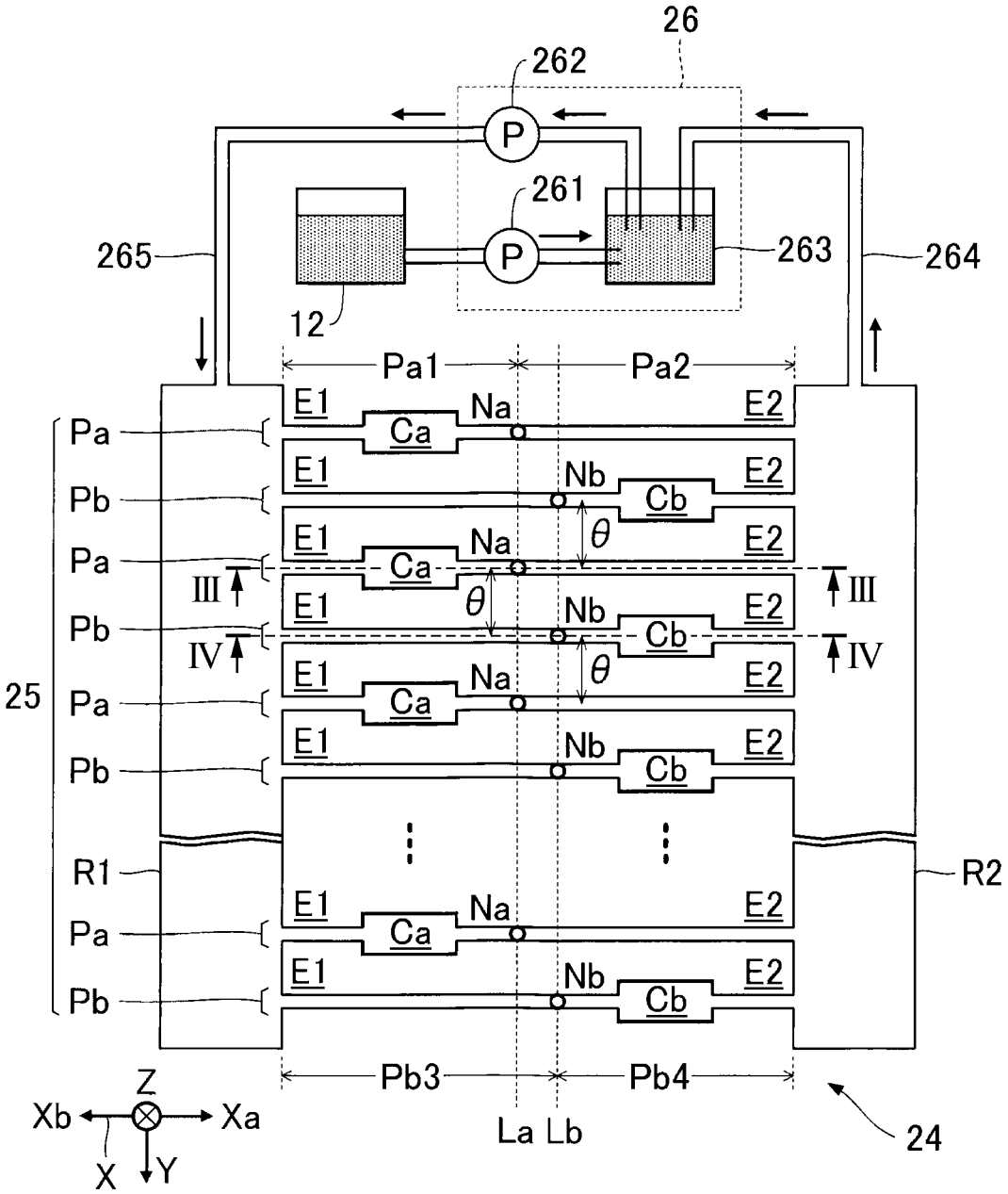
FIG. 2 is a schematic view of a flow path in a liquid ejecting head.

FIG. 2 is a configuration diagram schematically showing a flow path in the liquid ejecting head 24 when the liquid ejecting head 24 is viewed from a Z-axis direction. As illustrated in FIG. 2, a plurality of nozzles N (Na and Nb) are formed on the surface of the liquid ejecting head 24 facing the medium 11. The plurality of nozzles N are arranged along the Y axis. Ink is ejected from each of the plurality of nozzles N in the Z-axis direction. That is, the Z axis corresponds to a direction in which ink is ejected from each nozzle N. The Z axis is an example of the "first axis".

The plurality of nozzles N in the first embodiment are divided into a first nozzle row La and a second nozzle row Lb. The first nozzle row La is a set of a plurality of nozzles Na arranged linearly along the Y axis. Similarly, the second nozzle row Lb is a set of a plurality of nozzles Nb arranged linearly along the Y axis. The first nozzle row La and the second nozzle row Lb are arranged in parallel in an X-axis direction with a predetermined interval. Further, a position of each nozzle Na in a Y-axis direction is different from a position of each nozzle Nb in the Y-axis direction. As illustrated in FIG. 2, a plurality of nozzles N including a nozzle Na and a nozzle Nb are arranged at a pitch (cycle) θ. The pitch θ is a distance between centers of the nozzles Na and Nb in the Y-axis direction. In the following description, a subscript "a" is added to a reference numeral of an element related to the nozzle Na of the first nozzle row La, and a subscript "b" is added to a reference numeral of an element related to the nozzle Nb of the second nozzle row Lb. Note that, when it is not necessary to particularly distinguish the nozzle Na of the first nozzle row La and the nozzle Nb of the second nozzle row Lb, they are simply referred to as a "nozzle N". The same applies to the reference numerals of other elements.

As illustrated in FIG. 2, an individual flow path row 25 is installed in the liquid ejecting head 24. The individual flow path row 25 is a set of a plurality of individual flow paths P (Pa and Pb) corresponding to different nozzles N. Each of the plurality of individual flow paths P is a flow path that communicates with the nozzle N corresponding to the individual flow path P. Each individual flow path P extends along the X axis. The individual flow path row 25 is composed of a plurality of individual flow paths P arranged in parallel along the Y axis. Note that, in FIG. 2, each individual flow path P is illustrated as a simple straight line for convenience, but the actual shape of each individual flow path P will be described later. The Y axis is an example of the "second axis".

Each individual flow path P includes a pressure chamber C (Ca and Cb). The pressure chamber C in each individual flow path P is a space that stores ink ejected from the nozzle N communicating with the individual flow path P. That is, ink is ejected from the nozzle N when a pressure of ink in the pressure chamber C varies. Note that, when it is not necessary to distinguish between a pressure chamber Ca corresponding to the first nozzle row La and a pressure chamber Cb corresponding to the second nozzle row Lb, they are simply referred to as a "pressure chamber C".

As illustrated in FIG. 2, a first common liquid chamber R1 and a second common liquid chamber R2 are installed in the liquid ejecting head 24. Each of the first common liquid chamber R1 and the second common liquid chamber R2 extends in the Y-axis direction over an entire range in which the plurality of nozzles N are distributed. In plan view from the direction of the Z axis (hereinafter, simply referred to as a "plan view"), the individual flow path row 25 and the plurality of nozzles N are positioned between the first common liquid chamber R1 and the second common liquid chamber R2.

The plurality of individual flow paths P are commonly communicated with the first common liquid chamber R1. Specifically, an end E1 of each individual flow path P positioned in the Xb direction is coupled to the first common liquid chamber R1. Further, the plurality of individual flow paths P are commonly communicated with the second common liquid chamber R2. Specifically, an end E2 of each individual flow path P positioned in the Xa direction is coupled to the second common liquid chamber R2. As can be understood from the above description, each individual flow path P causes the first common liquid chamber R1 and the second common liquid chamber R2 to communicate with each other. Ink that is supplied from the first common liquid chamber R1 to each individual flow path P is ejected from the nozzle N corresponding to the individual flow path P. In addition, a portion of the ink that is supplied from the first common liquid chamber R1 to each individual flow path P and is not ejected from the nozzle N is discharged to the second common liquid chamber R2.

As illustrated in FIG. 2, the liquid ejecting system 100 according to the first embodiment includes a circulation mechanism 26. The circulation mechanism 26 is a mechanism for causing the ink discharged from each individual flow path P to the second common liquid chamber R2 to recirculate to the first common liquid chamber R1. Specifically, the circulation mechanism 26 includes a first supply pump 261, a second supply pump 262, a storage container 263, a circulation flow path 264, and a supply flow path 265.

The first supply pump 261 is a pump for supplying the ink stored in the liquid container 12 to the storage container 263. The storage container 263 is a sub-tank that temporarily stores the ink that is supplied from the liquid container 12. The circulation flow path 264 is a flow path that causes the second common liquid chamber R2 and the storage container 263 to communicate with each other. The ink stored in the liquid container 12 is supplied to the storage container 263 from the first supply pump 261, and the ink discharged from each individual flow path P to the second common liquid chamber R2 is supplied to the storage container 263 via the circulation flow path 264. The second supply pump 262 is a pump that sends out the ink stored in the storage container 263. The ink sent from the second supply pump 262 is supplied to the first common liquid chamber R1 via the supply flow path 265.

The plurality of individual flow paths P of the individual flow path row 25 include a plurality of first individual flow paths Pa and a plurality of second individual flow paths Pb. Each of the plurality of first individual flow paths Pa is an individual flow path P that communicates with one nozzle Na of the first nozzle row La. Each of the plurality of second individual flow paths Pb is an individual flow path P that communicates with one nozzle Nb of the second nozzle row Lb. The first individual flow paths Pa and the second individual flow paths Pb are arranged alternately along the Y axis. That is, the first individual flow path Pa and the second individual flow path Pb are adjacent to each other in the Y-axis direction. Note that, when there is no particular need to distinguish between the first individual flow path Pa and the second individual flow path Pb, they are simply referred to as an "individual flow path P".

The first individual flow path Pa includes a first portion Pa1 and a second portion Pa2. The first portion Pa1 of each first individual flow path Pa is a flow path between the end E1 of the first individual flow path Pa coupled to the first common liquid chamber R1 and the nozzle Na communicating with the first individual flow path Pa. The first portion Pa1 includes a pressure chamber Ca. On the other hand, the second portion Pa2 of each first individual flow path Pa is a flow path between the nozzle Na communicating with the first individual flow path Pa and the end E2 of the first individual flow path Pa coupled to the second common liquid chamber R2.

The second individual flow path Pb includes a third portion Pb3 and a fourth portion Pb4. The third portion Pb3 of each second individual flow path Pb is a flow path between the end E1 of the second individual flow path Pb coupled to the first common liquid chamber R1 and the nozzle Nb communicating with the second individual flow path Pb. On the other hand, the fourth portion Pb4 of each second individual flow path Pb is a flow path between the nozzle Nb communicating with the second individual flow path Pb and the end E2 of the second individual flow path Pb coupled to the second common liquid chamber R2. The fourth portion Pb4 includes a pressure chamber Cb.

As understood from the above description, the plurality of pressure chambers Ca corresponding to the different nozzles Na of the first nozzle row La are linearly arranged along the Y axis. Similarly, the plurality of pressure chambers Cb corresponding to the different nozzles Nb of the second nozzle row Lb are linearly arranged along the Y axis. The array of the plurality of pressure chambers Ca and the array of the plurality of pressure chambers Cb are arranged in parallel in the X-axis direction with a predetermined interval. The position of each pressure chamber Ca in the Y-axis direction is different from the position of each pressure chamber Cb in the Y-axis direction.

Moreover, as understood from FIG. 2, the first portion Pa1 of each first individual flow path Pa and the third portion Pb3 of each second individual flow path Pb are arranged in the Y-axis direction, and the second portion Pa2 of each first individual flow path Pa and the fourth portion Pb4 of each second individual flow path Pb are arranged in the Y-axis direction.

Figure 3:
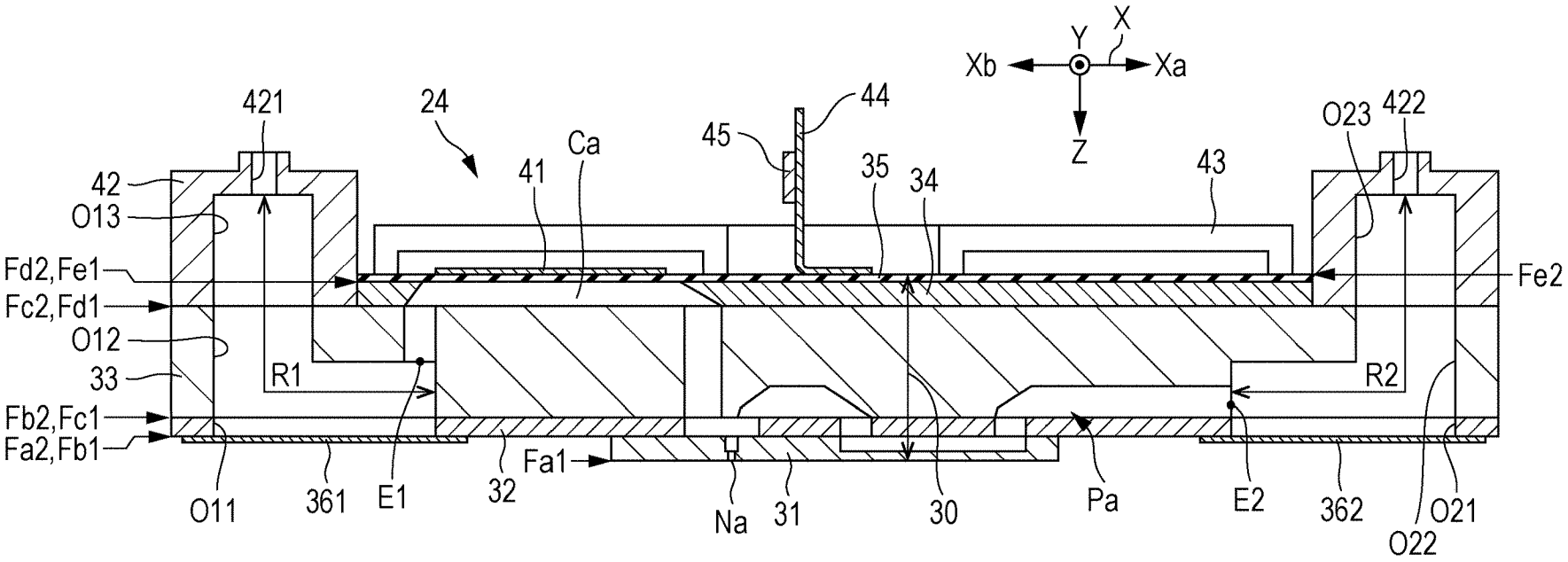
FIG. 3 is a sectional view of a liquid ejecting head in a cross-section that passes through a first individual flow path.
Figure 4:
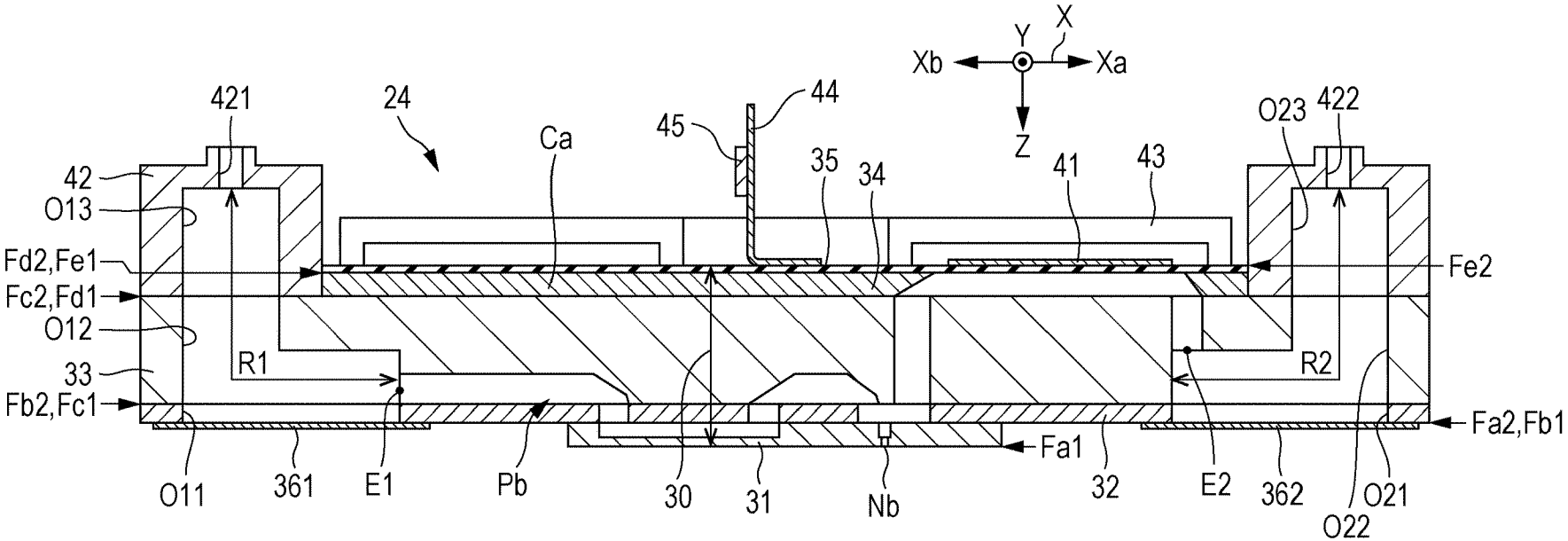
FIG. 4 is a sectional view of a liquid ejecting head in a cross-section that passes through a second individual flow path.

The specific configuration of the liquid ejecting head 24 will be described in detail below. FIG. 3 is a sectional view taken along line in FIG. 2, and FIG. 4 is a sectional view taken along line IV-IV in FIG. 2. A cross-section passing through the first individual flow path Pa is illustrated in FIG. 3, and a cross-section passing through the second individual flow path Pb is illustrated in FIG. 4.

As illustrated in FIGS. 3 and 4, the liquid ejecting head 24 includes a flow path structure 30, a plurality of piezoelectric elements 41, a housing portion 42, a protective substrate 43, and a wiring substrate 44. The flow path structure 30 is a structure in which a flow path including a first common liquid chamber R1, a second common liquid chamber R2, a plurality of individual flow paths P, and a plurality of nozzles N is formed.

The flow path structure 30 is a structure in which a nozzle plate 31, a first flow path substrate 32, a second flow path substrate 33, a pressure chamber substrate 34, and a vibrating plate 35 are stacked in the above order in a negative direction of the Z axis. Each member configuring the flow path structure 30 is manufactured by processing a silicon single crystal substrate using, for example, a semiconductor manufacturing technique.

A plurality of nozzles N are formed in the nozzle plate 31. Each of the plurality of nozzles N is a circular through-hole that allows ink to pass therethrough. The nozzle plate 31 of the first embodiment is a plate-shaped member including a surface Fa1 positioned in the positive direction of the Z axis and a surface Fa2 positioned in a negative direction of the Z axis.

Figure 5:
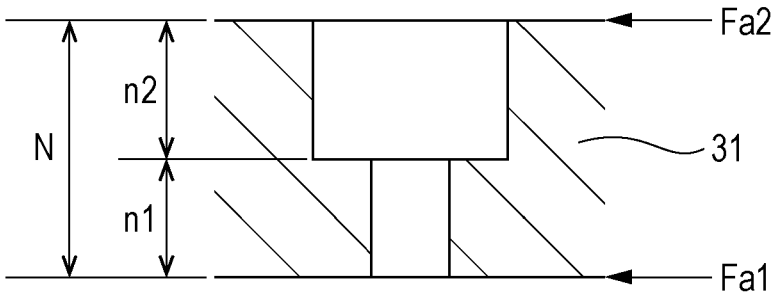
FIG. 5 is a sectional view illustrating a structure of a nozzle.

FIG. 5 is an enlarged sectional view of any one nozzle N. As illustrated in FIG. 5, one nozzle N includes a first section n1 and a second section n2. The first section n1 is a section of the nozzle N that includes an opening through which ink is ejected. That is, the first section n1 is a section continuous with the surface Fa1 of the nozzle plate 31. On the other hand, the second section n2 is a section between the first section n1 and the individual flow path P. That is, the second section n2 is a section continuous with the surface Fa2 of the nozzle plate 31. The second section n2 has a diameter larger than that of the first section n1.

The first flow path substrate 32 in FIGS. 3 and 4 is a plate-shaped member including a surface Fb1 positioned in the positive direction of the Z axis and a surface Fb2 positioned in the negative direction of the Z axis. The second flow path substrate 33 is a plate-shaped member including a surface Fc1 positioned in the positive direction of the Z axis and a surface Fc2 positioned in the negative direction of the Z axis. The second flow path substrate 33 is thicker than the first flow path substrate 32.

The pressure chamber substrate 34 is a plate-shaped member including a surface Fd1 positioned in the positive direction of the Z axis and a surface Fd2 positioned in the negative direction of the Z axis. The vibrating plate 35 is a plate-shaped member including a surface Fe1 positioned in the positive direction of the Z axis and a surface Fe2 positioned in the negative direction of the Z axis.

The respective members configuring the flow path structure 30 are formed in a rectangular shape elongated in the Y-axis direction, and are bonded to each other by, for example, an adhesive. For example, the surface Fa2 of the nozzle plate 31 is bonded to the surface Fb1 of the first flow path substrate 32, and the surface Fb2 of the first flow path substrate 32 is bonded to the surface Fc1 of the second flow path substrate 33. Further, the surface Fc2 of the second flow path substrate 33 is bonded to the surface Fd1 of the pressure chamber substrate 34, and the surface Fd2 of the pressure chamber substrate 34 is bonded to the surface Fe1 of the vibrating plate 35.

A space O11 and a space O21 are formed in the first flow path substrate 32. Each of the space O11 and the space O21 is an opening elongated in the Y-axis direction. In addition, a space O12 and a space O22 are formed in the second flow path substrate 33. Each of the space O12 and the space O22 is an opening elongated in the Y-axis direction. The space O11 and the space O12 communicate with each other. Similarly, the space O21 and the space O22 communicate with each other. On the surface Fb1 of the first flow path substrate 32, a vibration absorber 361 blocking the space O11 and a vibration absorber 362 blocking the space O21 are installed. The vibration absorber 361 and the vibration absorber 362 are layered members formed of an elastic material.

The housing portion 42 is a case for storing ink. The housing portion 42 is bonded to the surface Fc2 of the second flow path substrate 33. In the housing portion 42, a space O13 communicating with the space O12 and a space O23 communicating with the space O22 are formed. Each of the space O13 and the space O23 is a space elongated in the Y-axis direction. The space O11, the space O12, and the space O13 form a first common liquid chamber R1 by communicating with each other. Similarly, the space O21, the space O22, and the space O23 form a second common liquid chamber R2 by communicating with each other. The vibration absorber 361 configures a wall surface of the first common liquid chamber R1 and absorbs a pressure fluctuation of ink in the first common liquid chamber R1. The vibration absorber 362 configures a wall surface of the second common liquid chamber R2 and absorbs a pressure fluctuation of ink in the second common liquid chamber R2.

A supply port 421 and a discharge port 422 are formed in the housing portion 42. The supply port 421 is a pipe line communicating with the first common liquid chamber R1, and is coupled to the supply flow path 265 of the circulation mechanism 26. The ink sent from the second supply pump 262 to the supply flow path 265 is supplied to the first common liquid chamber R1 via the supply port 421. On the other hand, the discharge port 422 is a pipe line communicating with the second common liquid chamber R2, and is coupled to the circulation flow path 264 of the circulation mechanism 26. The ink in the second common liquid chamber R2 is supplied to the circulation flow path 264 via the discharge port 422.

A plurality of pressure chambers C (Ca and Cb) are formed in the pressure chamber substrate 34. Each pressure chamber C is a gap between the surface Fc2 of the second flow path substrate 33 and the surface Fe1 of the vibrating plate 35. Each pressure chamber C is formed in a long shape along the X axis in plan view.

The vibrating plate 35 is a plate-shaped member that can elastically vibrate. The vibrating plate 35 is, for example, configured by stacking a first layer of silicon oxide ($SiO_2$) and a second layer of zirconium oxide ($ZrO_2$). Note that, the vibrating plate 35 and the pressure chamber substrate 34 may be integrally formed by selectively removing a portion of the plate-shaped member having a predetermined thickness in a thickness direction with respect to a region corresponding to the pressure chamber C. Further, the vibrating plate 35 may be formed as a single layer.

A plurality of piezoelectric elements 41 corresponding to different pressure chambers C are installed on the surface Fe2 of the vibrating plate 35. The piezoelectric element 41 corresponding to each pressure chamber C overlaps the pressure chamber C in plan view. Specifically, each piezoelectric element 41 is configured by stacking a first electrode and a second electrode facing each other, and a piezoelectric layer formed between both electrodes. Each piezoelectric element 41 is an energy generating element that causes ink in the pressure chamber C to be ejected from the nozzle N by changing a pressure of the ink in the pressure chamber C. That is, when the piezoelectric element 41 is deformed by the supply of a drive signal, the vibrating plate 35 vibrates, and ink is ejected from the nozzle N as the pressure chamber C expands and contracts due to the vibration of the vibrating plate 35. The pressure chambers C (Ca and Cb) are defined as ranges in the individual flow path P in which the vibrating plate 35 vibrates due to the deformation of the piezoelectric element 41.

The protective substrate 43 is a plate-shaped member installed on the surface Fe2 of the vibrating plate 35, and protects the plurality of piezoelectric elements 41 and reinforces a mechanical strength of the vibrating plate 35. A plurality of piezoelectric elements 41 are housed between the protective substrate 43 and the vibrating plate 35. Further, a wiring substrate 44 is mounted on the surface Fe2 of the vibrating plate 35. The wiring substrate 44 is a mounting component for electrically coupling the control unit 21 and the liquid ejecting head 24. For example, a flexible wiring substrate 44 such as a flexible printed circuit (FPC) and a flexible flat cable (FFC) is preferably used. A drive circuit 45 for supplying a drive signal to each piezoelectric element 41 is mounted on the wiring substrate 44.

Figure 6:
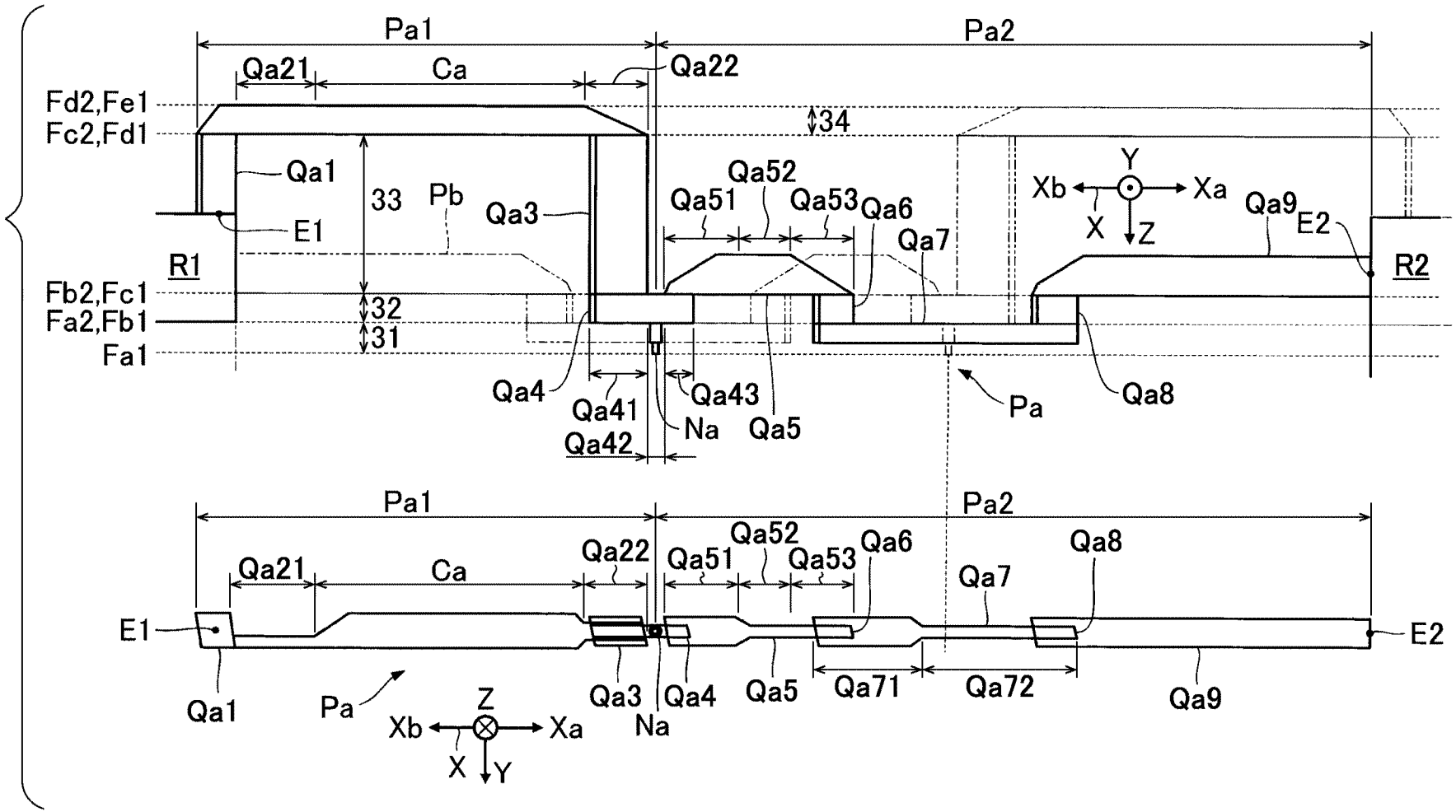
FIG. 6 shows a side view and a plan view illustrating a configuration of a first individual flow path.

A specific configuration of the individual flow path P will be described below. FIG. 6 shows a side view and a plan view illustrating the configuration of each first individual flow path Pa. In the following description, a width of the flow path in the Y-axis direction will be simply referred to as a "flow path width". As understood from FIG. 6 and FIG. 7 described later, the shape of the first individual flow path Pa and the shape of the second individual flow path Pb have a rotational symmetry relationship (that is, point symmetry) with respect to a symmetry axis parallel to the Z axis in plan view.

As illustrated in FIG. 6, the first individual flow path Pa is a flow path in which a first flow path Qa1, a communication flow path Qa21, a pressure chamber Ca, a second flow path Qa22, a third flow path Qa3, a fourth flow path Qa4, a fifth flow path Qa5, a sixth flow path Qa6, a seventh flow path Qa7, an eighth flow path Qa8, and a ninth flow path Qa9 are coupled in series in the above order from the first common liquid chamber R1 to the second common liquid chamber R2.

The first flow path Qa1 is a space formed in the second flow path substrate 33. Specifically, the first flow path Qa1 extends from the space O12 configuring the first common liquid chamber R1 to the surface Fc2 of the second flow path substrate 33 along the Z axis. An end of the first flow path Qa1 coupled to the space O12 is an end E1 of the first individual flow path Pa. The communication flow path Qa21 is a space formed in the pressure chamber substrate 34 together with the pressure chamber Ca, and causes the first flow path Qa1 and the pressure chamber Ca to communicate with each other. That is, the communication flow path Qa21 is positioned between the pressure chamber Ca and the first common liquid chamber R1. The communication flow path Qa21 is a throttle flow path having a narrower flow path cross-sectional area than the pressure chamber Ca. The flow path cross-sectional area of the communication flow path Qa21 is smaller than a minimum flow path cross-sectional area of the second portion Pa2. That is, a flow path resistance is locally high in the communication flow path Qa21 of the first individual flow path Pa.

The second flow path Qa22 is a flow path that causes the pressure chamber Ca and the third flow path Qa3 to communicate with each other, and communicates with the end of the pressure chamber Ca in the Xa direction. The flow path cross-sectional area of the second flow path Qa22 is smaller than a flow path cross-sectional area of the pressure chamber Ca.

The third flow path Qa3 is a space penetrating the second flow path substrate 33. The third flow path Qa3 overlaps the second flow path Qa22 in plan view. That is, the third flow path Qa3 communicates with the pressure chamber Ca via the second flow path Qa22. The third flow path Qa3 is a long flow path along the Z axis. A flow path width of the third flow path Qa3 is slightly smaller than a flow path width of the pressure chamber Ca. However, the flow path width of the third flow path Qa3 may be equal to a maximum width of the pressure chamber Ca. Further, the flow path width of the third flow path Qa3 exceeds a flow path width of the second flow path Qa22.

The fourth flow path Qa4 is a space penetrating the first flow path substrate 32 and extends along the X axis. A flow path width of the fourth flow path Qa4 is smaller than the flow path width of the third flow path Qa3. The fourth flow path Qa4 is divided into a portion Qa41, a portion Qa42, and a portion Qa43 along the X axis. The portion Qa41 is positioned in the Xb direction with respect to the portion Qa42, and the portion Qa43 is positioned in the Xa direction with respect to the portion Qa42. Flow path widths of the portion Qa41, the portion Qa42, and the portion Qa43 are equal. The portion Qa41 overlaps the third flow path Qa3 in plan view. That is, the portion Qa41 communicates with the third flow path Qa3. The nozzle Na corresponding to the first individual flow path Pa overlaps the portion Qa42 of the fourth flow path Qa4 in plan view. That is, the nozzle Na communicates with the portion Qa42. The nozzle Na does not overlap the third flow path Qa3 and the fifth flow path Qa5 in plan view. However, the position of the nozzle Na with respect to the fourth flow path Qa4 can be appropriately changed.

The fifth flow path Qa5 is a groove formed on the surface Fc1 of the second flow path substrate 33, and extends along the X axis. The fifth flow path Qa5 is divided into a portion Qa51, a portion Qa52, and a portion Qa53 along the X axis. The portion Qa51 is positioned in the Xb direction with respect to the portion Qa52, and the portion Qa53 is positioned in the Xa direction with respect to the portion Qa52. The portion Qa51 of the fifth flow path Qa5 overlaps the portion Qa43 of the fourth flow path Qa4 in plan view. Flow path widths of the portion Qa52 and the portion Qa53 are smaller than a flow path width of the portion Qa51. Specifically, the flow path width of the portion Qa51 is larger than the flow path width of the fourth flow path Qa4, and the flow path widths of the portions Qa52 and Qa53 are equal to the flow path width of the fourth flow path Qa4. The flow path width of the portion Qa51 is equal to the flow path width of the third flow path Qa3.

An upper surface of the portion Qa51 includes an inclined surface of which an edge on the Xa side is higher than an edge on the Xb side. In addition, an upper surface of the portion Qa53 includes an inclined surface of which an edge on the Xb side is higher than an edge on the Xa side. That is, the fifth flow path Qa5 has a substantially trapezoidal shape when viewed in the Y-axis direction.

The sixth flow path Qa6 is a space penetrating the first flow path substrate 32 and extends along the X axis. The portion Qa53 of the fifth flow path Qa5 overlaps the sixth flow path Qa6 in plan view. That is, the sixth flow path Qa6 communicates with the portion Qa53. Further, a flow path width of the sixth flow path Qa6 is equal to the flow path width of the portion Qa53 of the fifth flow path Qa5.

The seventh flow path Qa7 is a groove formed on the surface Fa2 of the nozzle plate 31, and extends along the X axis. The seventh flow path Qa7 is divided into a portion Qa71 and a portion Qa72 along the X axis. The portion Qa71 is positioned in the Xb direction with respect to the portion Qa72. A flow path width of the portion Qa71 is larger than a flow path width of the portion Qa72. Specifically, the flow path width of the portion Qa71 is equal to the flow path widths of the portion Qa51 of the fifth flow path Qa5 and the third flow path Qa3, and the flow path width of the portion Qa72 is equal to the flow path widths of the portions Qa52 and Qa53 of the fifth flow path Qa5. The sixth flow path Qa6 overlaps an end of the portion Qa71 of the seventh flow path Qa7 positioned in the Xb direction in plan view. That is, the sixth flow path Qa6 communicates with the portion Qa71 of the seventh flow path Qa7.

The eighth flow path Qa8 is a space penetrating the first flow path substrate 32 and extends along the X axis. A flow path width of the eighth flow path Qa8 is equal to a flow path width of the portion Qa72 of the seventh flow path Qa7. The eighth flow path Qa8 overlaps an end of the portion Qa72 of the seventh flow path Qa7 positioned in the Xa direction in plan view. That is, the eighth flow path Qa8 communicates with the portion Qa72 of the seventh flow path Qa7.

The ninth flow path Qa9 is a groove formed on the surface Fc1 of the second flow path substrate 33, and extends along the X axis. An end of the ninth flow path Qa9 in the Xb direction overlaps the eighth flow path Qa8 in plan view. That is, the ninth flow path Qa9 communicates with the eighth flow path Qa8. An end of the ninth flow path Qa9 in the Xa direction is coupled to the second common liquid chamber R2. An end of the ninth flow path Qa9 coupled to the second common liquid chamber R2 is an end E2 of the first individual flow path Pa. A flow path width of the ninth flow path Qa9 is equal to the flow path width of the third flow path Qa3.

In the above configuration, ink in the first common liquid chamber R1 is supplied to the pressure chamber Ca via the first flow path Qa1 and the communication flow path Qa21. A portion of the ink that is supplied from the pressure chamber Ca to the fourth flow path Qa4 via the second flow path Qa22 and the third flow path Qa3 is ejected from the nozzle Na. Further, a portion of the ink that is supplied to the fourth flow path Qa4 and is not ejected from the nozzle Na is supplied to the second common liquid chamber R2 via the fourth flow path Qa4 to the ninth flow path Qa9 in order. As can be understood from the above description, the first portion Pa1 is a flow path on an upstream of the nozzle Na, and the second portion Pa2 is a flow path on a downstream of the nozzle Na.

The first portion Pa1 of the first individual flow path Pa is composed of the first flow path Qa1, the communication flow path Qa21, the pressure chamber Ca, the second flow path Qa22, the third flow path Qa3, and the portion Qa41 of the fourth flow path Qa4. The second portion Pa2 of the first individual flow path Pa is composed of the portion Qa43 of the fourth flow path Qa4 and the fifth flow path Qa5 to the ninth flow path Qa9. In the first individual flow path Pa, when the vibrating plate 35 vibrates in association with the deformation of the piezoelectric element 41 corresponding to the pressure chamber Ca, the pressure inside the pressure chamber Ca fluctuates, so that the ink filled in the pressure chamber Ca is ejected from the nozzle Na.

Figure 7:
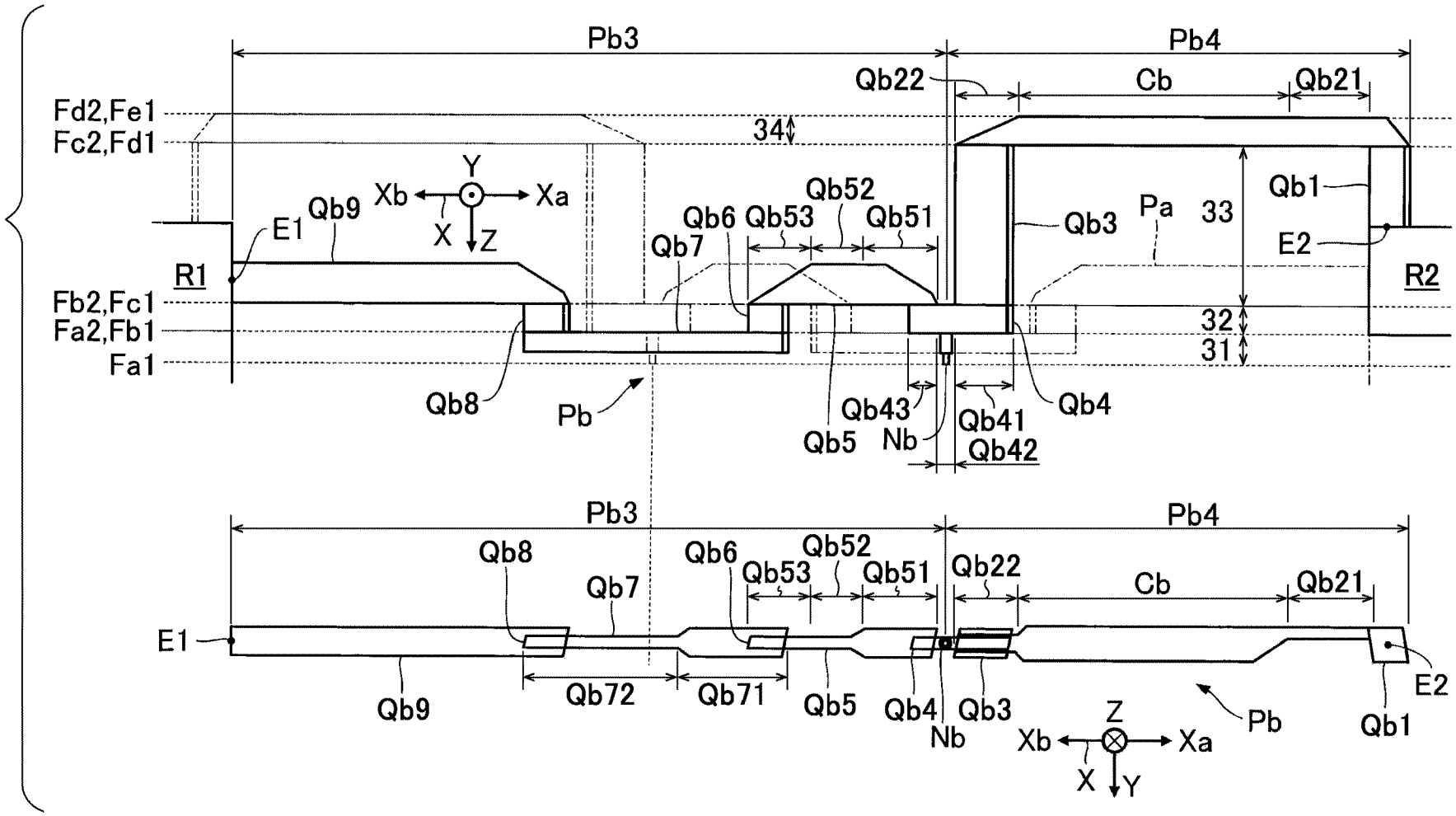
FIG. 7 shows a side view and a plan view illustrating a configuration of a second individual flow path.

FIG. 7 shows a side view and a plan view illustrating the configuration of each second individual flow path Pb. The second individual flow path Pb has a configuration in which the first individual flow path Pa is inverted in the X-axis direction. Specifically, the second individual flow path Pb is a flow path in which a first flow path Qb1, a communication flow path Qb21, a pressure chamber Cb, a second flow path Qb22, a third flow path Qb3, a fourth flow path Qb4, a fifth flow path Qb5, a sixth flow path Qb6, a seventh flow path Qb7, an eighth flow path Qb8, and a ninth flow path Qb9 are coupled in series in the above order from the second common liquid chamber R2 to the first common liquid chamber R1. The description regarding the structure of each flow path (Qa1 to Qb9) in the first individual flow path Pa is similarly established as the description regarding the structure of each flow path (Qb1 to Qb9) in the second individual flow path Pb by replacing the subscript "a" in the reference numeral of each element with the subscript "b".

In the above configuration, the ink in the first common liquid chamber R1 is supplied to the pressure chamber Cb via the ninth flow path Qb9, the eighth flow path Qb8, the seventh flow path Qb7, the sixth flow path Qb6, the fifth flow path Qb5, the fourth flow path Qb4, the third flow path Qb3, and the second flow path Qb22. A portion of the ink that is supplied to the fourth flow path Qb4 is ejected from the nozzle Nb. Further, a portion of the ink that is supplied to the fourth flow path Qb4 and is not ejected from the nozzle Nb is supplied to the second common liquid chamber R2 via the fourth flow path Qb4, the third flow path Qb3, the second flow path Qb22, the pressure chamber Cb, the communication flow path Qb21, and the first flow path Qb1 in order. As can be understood from the above description, the third portion Pb3 is a flow path on an upstream of the nozzle Nb, and the fourth portion Pb4 is a flow path on a downstream of the nozzle Nb.

The third portion Pb3 of the second individual flow path Pb is composed of a portion Qb43 of the fourth flow path Qb4 and the fifth flow path Qb5 to the ninth flow path Qb9. The fourth portion Pb4 of the second individual flow path Pb is composed of the first flow path Qb1, the communication flow path Qb21, the pressure chamber Cb, the second flow path Qb22, the third flow path Qb3, and the portion Qb41 of the fourth flow path Qb4. In the second individual flow path Pb, when the vibrating plate 35 vibrates in association with the deformation of the piezoelectric element 41 corresponding to the pressure chamber Cb, the pressure inside the pressure chamber Cb fluctuates, so that the ink filled in the pressure chamber Cb is ejected from the nozzle Nb.

In the first embodiment, an inertance M1 of the first portion Pa1 is smaller than an inertance M2 of the second portion Pa2 (M1<M2), and an inertance M4 of the fourth portion Pb4 is smaller than an inertance M3 of the third portion Pb3 (M4<M3). The inertance M of the flow path is expressed, for example, by the following Expression (1). In Expression (1), a symbol p means an ink density, a symbol L means a flow path length, and a symbol S means a flow path cross-sectional area. The inertance M of the flow path composed of a plurality of sections having different flow path cross-sectional areas S is calculated as a total value of the inertance in each section. As understood from Expression (1), the inertance M can be set by adjusting the flow path length L and the flow path cross-sectional area S.

$$M=\rho L/S \tag{1}$$

The pressure fluctuation generated in the pressure chamber Ca by the operation of the piezoelectric element 41 causes a flow of ink toward the nozzle Na in the first portion Pa1. In the first portion Pa1, a portion of the ink directed to the nozzle Na is ejected from the nozzle Na, and the remaining ink flows into the second portion Pa2. In order to improve an ejection efficiency from the nozzles Na by relatively reducing the ink that flows into the second portion Pa2 without being ejected from the nozzles Na, a configuration in which the inertance of the second portion Pa2 is relatively large is preferable. From the above viewpoint, the first embodiment adopts a configuration in which the inertance M1 of the first portion Pa1 is smaller than the inertance M2 of the second portion Pa2. Specifically, a flow path length L1 of the first portion Pa1 is shorter than a flow path length L2 of the second portion Pa2 (L1<L2).

Similarly, the pressure fluctuation generated in the pressure chamber Cb by the operation of the piezoelectric element 41 causes a flow of ink toward the nozzle Nb in the fourth portion Pb4. In the fourth portion Pb4, a portion of the ink directed to the nozzle Nb is ejected from the nozzle Nb, and the remaining ink flows into the third portion Pb3. In order to improve an ejection efficiency from the nozzle Nb by relatively reducing the ink that flows into the third portion Pb3 without being ejected from the nozzle Nb, a configuration in which the inertance of the third portion Pb3 is relatively large is preferable. From the above viewpoint, the first embodiment adopts a configuration in which the inertance M4 of the fourth portion Pb4 is smaller than the inertance M3 of the third portion Pb3. Specifically, a flow path length L4 of the fourth portion Pb4 is shorter than a flow path length L3 of the third portion Pb3 (L4<L3).

As understood from FIG. 2, the first portion Pa1 having a smaller inertance than the second portion Pa2 and the third portion Pb3 having a larger inertance than the fourth portion Pb4 are arranged in the Y-axis direction. Similarly, the second portion Pa2 having a larger inertance than the first portion Pa1 and the fourth portion Pb4 having a smaller inertance than the third portion Pb3 are arranged in the Y-axis direction. That is, a range having a large inertance and a range having a small inertance are appropriately dispersed in the X-Y plane. Therefore, the flow path can be disposed more efficiently than in a case where the individual flow path row 25 is configured by only one of the first individual flow path Pa and the second individual flow path Pb.

As described above, the ink in the first common liquid chamber R1 is supplied to the nozzle Na via the first portion Pa1 of the first individual flow path Pa and is supplied to the nozzle Nb via the third portion Pb3 of the second individual flow path Pb. Here, a configuration in which a flow path resistance λa1 of the first portion Pa1 and a flow path resistance λb3 of the third portion Pb3 are different is assumed as a comparative example. In the comparative example, a pressure loss from the first common liquid chamber R1 to the nozzle Na is different from a pressure loss from the first common liquid chamber R1 to the nozzle Nb. Therefore, an ink pressure at the nozzle Na and an ink pressure at the nozzle Nb are different, resulting in an error between an ejection characteristic of the nozzle Na and an ejection characteristic of the nozzle Nb. The ejection characteristic is, for example, an ejection amount or an ejection speed.

In order to solve the above problems, in the first embodiment, the flow path resistance λLa1 of the first portion Pa1 and the flow path resistance λb3 of the third portion Pb3 are substantially equal (λa1=λb3). According to the above configuration, the pressure loss from the first common liquid chamber R1 to the nozzle Na and the pressure loss from the first common liquid chamber R1 to the nozzle Nb are substantially equal. That is, the ink pressure at the nozzle Na and the ink pressure at the nozzle Nb are substantially equal. Therefore, the error between the ejection characteristic of the nozzle Na and the ejection characteristic of the nozzle Nb can be reduced.

However, even when the flow path resistance λa1 of the first portion Pa1 and the flow path resistance λb3 of the third portion Pb3 are substantially equal, in the configuration in which a flow path resistance λa2 of the second portion Pa2 and a flow path resistance λb4 of the fourth portion Pb4 are significantly different, a pressure loss from the second common liquid chamber R2 to the nozzle Na is different from a pressure loss from the second common liquid chamber R2 to the nozzle Nb. Therefore, the ink pressure at the nozzle Na and the ink pressure at the nozzle Nb differ, and as a result, an error may occur between the ejection characteristic of the nozzle Na and the ejection characteristic of the nozzle Nb.

In order to solve the above problems, in the first embodiment, the flow path resistance λa2 of the second portion Pa2 and the flow path resistance λb4 of the fourth portion Pb4 are substantially equal (λa2=λb4). According to the above configuration, the pressure loss from the second common liquid chamber R2 to the nozzle Na and the pressure loss from the second common liquid chamber R2 to the nozzle Nb are substantially equal. Therefore, the error between the ejection characteristic of the nozzle Na and the ejection characteristic of the nozzle Nb can be effectively reduced.

Further, as understood from the description described above, in the first embodiment, the shape of the second portion Pa2 of the first individual flow path Pa and the shape of the third portion Pb3 of the second individual flow path Pb correspond to each other. Therefore, the flow path resistance λa2 of the second portion Pa2 and the flow path resistance λb3 of the third portion Pb3 are substantially equal. Similarly, the shape of the first portion Pa1 of the first individual flow path Pa and the shape of the fourth portion Pb4 of the second individual flow path Pb correspond to each other. Therefore, the flow path resistance λa1 of the first portion Pa1 and the flow path resistance λb4 of the fourth portion Pb4 are substantially equal. Here, as described above, the flow path resistance λa1 of the first portion Pa1 and the flow path resistance λb3 of the third portion Pb3 are substantially equal, and the flow path resistance λ2 of the second portion Pa2 and the flow path resistance λb4 of the fourth portion Pb4 are substantially equal. Therefore, in the first individual flow path Pa, the flow path resistance λa1 of the first portion Pa1 and the flow path resistance λa2 of the second portion Pa2 are substantially equal (λa1=λa2), and in the second individual flow path Pb, the flow path resistance λb3 of the third portion Pb3 and the flow path resistance λb4 of the fourth portion Pb4 are substantially equal (λb3=λb4).

From a paradoxical point of view, the first individual flow path Pa and the second individual flow path Pb are designed so that the flow path resistance λa1 and the flow path resistance λa2 are substantially equal and the flow path resistance λb3 and the flow path resistance λb4 are substantially equal. Therefore, even though the first individual flow path Pa and the second individual flow path Pb have different structures between the upstream and the downstream of the nozzle N, it can be said that the flow path resistance λa1 and the flow path resistance λb3 can be substantially equalized, and the flow path resistance λa2 and the flow path resistance λb4 can be substantially equalized.

As described above, after all, in the first embodiment, the flow path resistance λa1, the flow path resistance λa2, the flow path resistance λb3, and the flow path resistance λb4 are substantially equal. Therefore, the flow path resistance Xa of the first individual flow path Pa and the flow path resistance Xb of the second individual flow path Pb are substantially equal. The flow path resistance Xa of the first individual flow path Pa is a total value of the flow path resistance λa1 of the first portion Pa1 and the flow path resistance λa2 of the second portion Pa2. The flow path resistance Xb of the second individual flow path Pb is a total value of the flow path resistance λb3 of the third portion Pb3 and the flow path resistance λb4 of the fourth portion Pb4. As described above, according to the configuration in which the flow path resistance Xa of the first individual flow path Pa and the flow path resistance Xb of the second individual flow path Pb are substantially equal, it is possible to reduce the error in the ejection characteristic between each nozzle Na of the first nozzle row La and each nozzle Nb of the second nozzle row Lb.

Note that, the fact that "the flow path resistance λ1 and the flow path resistance λ2 are substantially equal" includes, in addition to a case where the flow path resistance λ1 and the flow path resistance λ2 are exactly the same, a case where a difference between the flow path resistance λ1 and the flow path resistance λ2 is small enough to be evaluated as substantially equal is also included. Specifically, for example, when the flow path resistance λ1 and the flow path resistance λ2 are within a manufacturing error range, it can be interpreted as "substantially equal". For example, when the following Expression (2) is established for the flow path resistance λ1 and the flow path resistance λ2, it can be interpreted that the flow path resistance λ1 and the flow path resistance λ2 are substantially equal.

$$0.45 \leq \lambda 1/(\lambda 1+\lambda 2) \leq 0.55 \quad (2)$$

As described above, in the first individual flow path Pa, a characteristic configuration is adopted in which the flow path resistance λa1 of the first portion Pa1 and the flow path resistance λa2 of the second portion Pa2 are substantially equal (λa1=λa2) while making the inertance M1 of the first portion Pa1 and the inertance M2 of the second portion Pa2 different from each other (M1<M2).

As can be understood from the above Expression (1), the inertance in the flow path is inversely proportional to the flow path cross-sectional area. On the other hand, the flow path resistance is inversely proportional to the square of the flow path cross-sectional area. That is, it can be said that a narrow flow path having a small flow path cross-sectional area such as the communication flow path Qa21 has the effect of significantly increasing the flow path resistance as compared to the increase in the inertance. Further, from the opposite viewpoint, it can be said that the narrow flow path has only an action of adding a small inertance as compared with an action of adding the flow path resistance. Therefore, when designing the first individual flow path Pa having the above feature, it is preferable that the first portion Pa1 having a relatively small inertance has a relatively small flow path cross-sectional area. For this reason, in the first embodiment, the communication flow path Qa21 of the first portion Pa1 is a narrow flow path having the narrowest flow path cross-sectional area throughout the entire first individual flow path Pa. Further, when such a narrow flow path is provided in a communicating portion (first local flow path H1) between the pressure chamber Ca and the nozzle Na, the flow between the pressure chamber Ca and the nozzle Na is obstructed and the ejection efficiency is decreased. Therefore, the communication flow path Qa21 in the first embodiment is provided between the pressure chamber Ca and the first common liquid chamber R1. The same applies to the relationship between the second individual flow path Pb and the communication flow path Qb21.

By the way, the pressure fluctuation generated in each pressure chamber C may propagate to the first common liquid chamber R1 or the second common liquid chamber R2. Therefore, a phenomenon (hereinafter referred to as a "crosstalk") in which the pressure fluctuation propagates from one of the first individual flow path Pa and the second individual flow path Pb adjacent to each other to the other via the first common liquid chamber R1 or the second common liquid chamber R2 can be a problem.

In consideration of the above circumstances, in the first embodiment, the position of the end E1 of the first individual flow path Pa coupled to the first common liquid chamber R1 and the position of the end E1 of the second individual flow path Pb coupled to the first common liquid chamber R1 are different in the Z-axis direction. According to the above configuration, it is easy to secure the distance between the end E1 of the first individual flow path Pa and the end E1 of the second individual flow path Pb. Therefore, a mutual influence of a flux generated near the end E1 of the first individual flow path Pa and a flux generated near the end E1 of the second individual flow path Pb is reduced. That is, the crosstalk between the two individual flow paths P adjacent to each other can be reduced.

Similarly, the position of the end E2 of the first individual flow path Pa coupled to the second common liquid chamber R2 and the position of the end E2 of the second individual flow path Pb coupled to the second common liquid chamber R2 are different in the Z-axis direction. According to the above configuration, it is easy to secure the distance between the end E2 of the first individual flow path Pa and the end E2 of the second individual flow path Pb. Therefore, the crosstalk between the two individual flow paths P adjacent to each other can be reduced.

Further, in the first embodiment, the direction of the first individual flow path Pa at the end E1 with respect to the first common liquid chamber R1 and the direction of the second individual flow path Pb at the end E1 with respect to the first common liquid chamber R1 are different. Specifically, the first individual flow path Pa (first flow path Qa1) is coupled to the first common liquid chamber R1 in the Z-axis direction at the end E1, while the second individual flow path Pb (ninth flow path Qb9) is coupled to the first common liquid chamber R1 in the X-axis direction at the end E1. According to the above configuration, the flux generated near the end E1 of the first individual flow path Pa and the flux generated near the end E1 of the second individual flow path Pb are unlikely to affect each other. Therefore, the crosstalk between the two individual flow paths P adjacent to each other can be reduced.

Similarly, the direction of the first individual flow path Pa at the end E2 with respect to the second common liquid chamber R2 and the direction of the second individual flow path Pb at the end E2 with respect to the second common liquid chamber R2 are different. Specifically, the first individual flow path Pa (ninth flow path Qa9) is coupled to the second common liquid chamber R2 in the X-axis direction at the end E2, while the second individual flow path Pb(first flow path Qb1) is coupled to the second common liquid chamber R2 in the Z-axis direction at the end E2. According to the above configuration, the flux generated near the end E2 of the first individual flow path Pa and the flux generated near the end E2 of the second individual flow path Pb are unlikely to affect each other. Therefore, the crosstalk between the two individual flow paths P adjacent to each other can be reduced.

The characteristic structure of each individual flow path P will be described by focusing on the two individual flow paths P (first individual flow path Pa and second individual flow path Pb) that are adjacent to each other in the individual flow path row 25 along the Y axis. The structure of the individual flow path P will be described for each of the first to fourth features of the individual flow path P that differ in the part to be focused. Note that, the following configuration may be adopted for all combinations obtained by selecting the two individual flow paths P that are adjacent to each other from the individual flow path row 25, and the following configuration may be adopted for only some of the combinations of the individual flow path row 25 that are adjacent to each other in the Y-axis direction.

In the following description, the "density" of the flow path means the number of flow paths per unit length in the Y-axis direction, which is grasped when the individual flow path row 25 is viewed in the Z-axis direction. The higher the density of the flow paths, the smaller the pitch of the flow paths in the Y-axis direction. Further, the "low density" of the flow path means that the density of the flow path is low compared to the density (nozzle density) of the plurality of nozzles N including the nozzles Na and Nb. The "high density" of the flow path means that the density is equivalent to the density of the plurality of nozzles N. According to the configuration in which the flow path is disposed at a low density, for example, the flow path resistance or the inertance is reduced by securing the flow path width. In the configuration in which the flow path is disposed at a high density, it is difficult to secure a sufficient thickness of a partition wall that defines each flow path that is adjacent to each other in the Y-axis direction. Therefore, the partition wall between the flow paths may be deformed in association with the pressure fluctuation of the ink in the flow path, and as a result, there is a possibility that the crosstalk may occur between the flow paths, in which pressure fluctuations affect each other. According to the configuration in which the flow path is disposed at a low density, it is easy to secure the thicknesses of the partition walls between the flow paths, so that there is an advantage that the crosstalk between the flow paths can be reduced. On the other hand, according to the configuration in which the flow path is disposed at a high density, a dead space where the flow paths are not formed inside the liquid ejecting head 24 is reduced. That is, a limited space in the liquid ejecting head 24 can be efficiently used for forming the flow path.

Assuming a configuration in which the flow path is disposed only at a high density as a comparative example, it is difficult to secure a sufficient flow path width, and therefore it is difficult to sufficiently reduce the flow path resistance of the entire flow path. Therefore, the pressure loss of the ink flowing in the flow path is large, and as a result, it is difficult to secure a sufficient ejection amount or an ejection speed. Further, as described above, there is also a problem that the crosstalk becomes apparent. On the other hand, assuming a configuration in which the flow path is disposed only at a low density as a comparative example, various restrictions are imposed on the routing positions of the individual flow paths P in order to realize the low density disposition. Therefore, it is difficult to realize a sufficiently high nozzle density under such restrictions. As can be understood from the above description, in order to achieve a high level of both the reduction of the pressure loss or the crosstalk in the flow path and the realization of the high nozzle density, it is very important to have a design concept of partially disposing the flow path at a high density, based on the low density disposition as a whole. Each feature described below is a characteristic configuration in the background of the circumstances described above.

A1: First Feature

Figure 8:
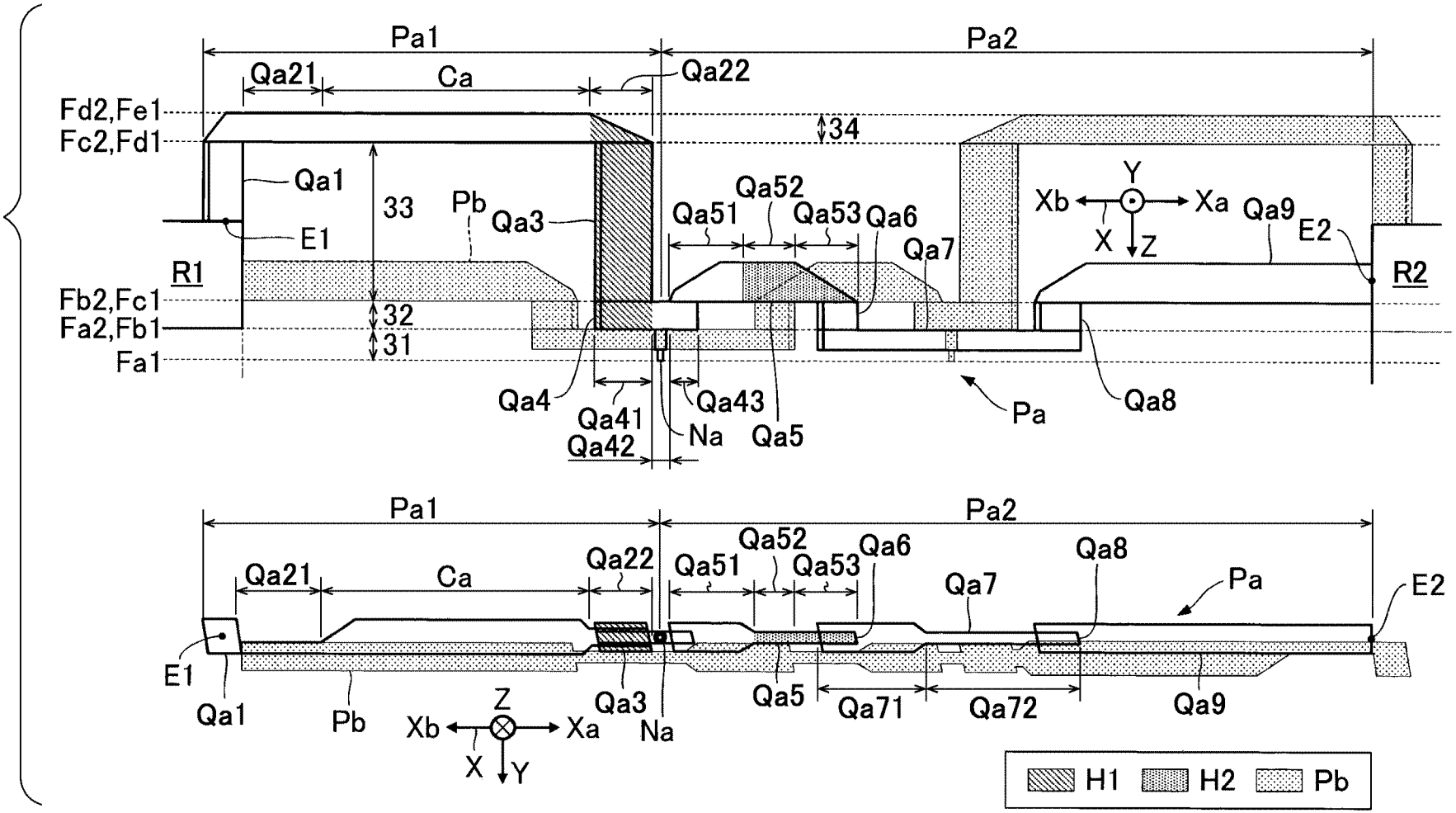
FIG. 8 shows a side view and a plan view of a first individual flow path focusing on a first local flow path.
Figure 9:
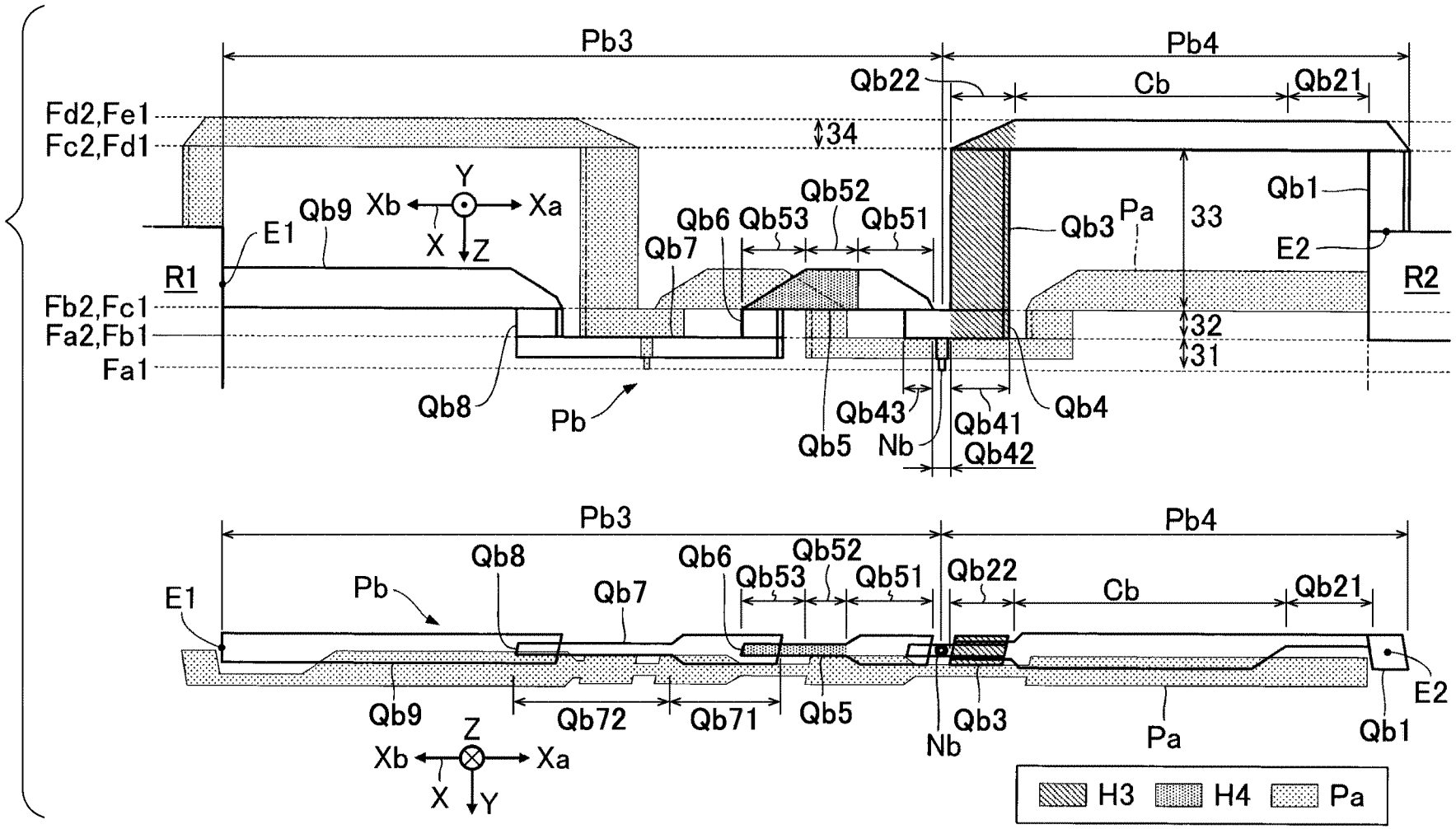
FIG. 9 shows a side view and a plan view of a second individual flow path focusing on a third local flow path.

FIG. 8 shows a side view and a plan view of the first individual flow path Pa, and FIG. 9 shows a side view and a plan view of the second individual flow path Pb. In FIG. 8, the outer shape of the second individual flow path Pb is shown in a shaded manner, and in FIG. 9, the outer shape of the first individual flow path Pa is shown in a shaded manner.

The first local flow path H1 illustrated in FIG. 8 is a portion of the first individual flow path Pa that causes the pressure chamber Ca and the nozzle Na to communicate with each other. Specifically, the first local flow path H1 is composed of the second flow path Qa22, the third flow path Qa3, and the portion Qa41 of the fourth flow path Qa4 of the first individual flow path Pa. As understood from FIG. 8, the first local flow path H1 does not overlap the second individual flow path Pb when viewed in the Y-axis direction. That is, the second individual flow path Pb does not exist in a gap between the first local flow paths H1 of the respective first individual flow paths Pa adjacent to each other in the Y-axis direction.

According to the above configuration, the first local flow paths H1 of the respective first individual flow paths Pa can be disposed at a low density in the Y-axis direction, compared with the configuration in which the first local flow path H1 overlaps the second individual flow path Pb when viewed in the Y-axis direction. The first local flow path H1 that causes the pressure chamber Ca and the nozzle Na to communicate with each other is a flow path that has a great influence on the ejection characteristic of the ink from the nozzle Na in the first individual flow path Pa. Therefore, the above configuration in which the first local flow path H1 is disposed at a low density is particularly effective.

As understood from FIG. 8, in the first embodiment, the pressure chamber Ca in the first individual flow path Pa does not overlap the second individual flow path Pb when viewed in the Y-axis direction. Therefore, the pressure chamber Ca can be disposed at a low density in the Y-axis direction as compared with the configuration in which the pressure chamber Ca overlaps the second individual flow path Pb when viewed in the Y-axis direction. According to the configuration in which the pressure chamber Ca is disposed at a low density, it is easy to secure the flow path width of the pressure chamber Ca. Therefore, there is an advantage that the ejection amount of the ink from the nozzle Na can be sufficiently secured by increasing an excluded volume of the pressure chamber Ca. Further, according to the configuration in which the pressure chamber Ca is disposed at a low density, it is easy to secure the thickness of the partition wall that defines each pressure chamber Ca. Therefore, the crosstalk between the pressure chambers Ca can be effectively reduced.

The second local flow path H2 illustrated in FIG. 8 is a portion of the first individual flow path Pa that overlaps the second individual flow path Pb when viewed in the Y-axis direction. Specifically, the second local flow path H2 is composed of the portion Qa52 and the portion Qa53 of the fifth flow path Qa5 of the first individual flow path Pa. Specifically, the second local flow path H2 overlaps the portions Qb52 and Qb53 of the fifth flow path Qb5 of the second individual flow path Pb when viewed in the Y-axis direction. That is, the individual flow path P is disposed at a high density in the portion corresponding to the second local flow path H2.

Figure 10:
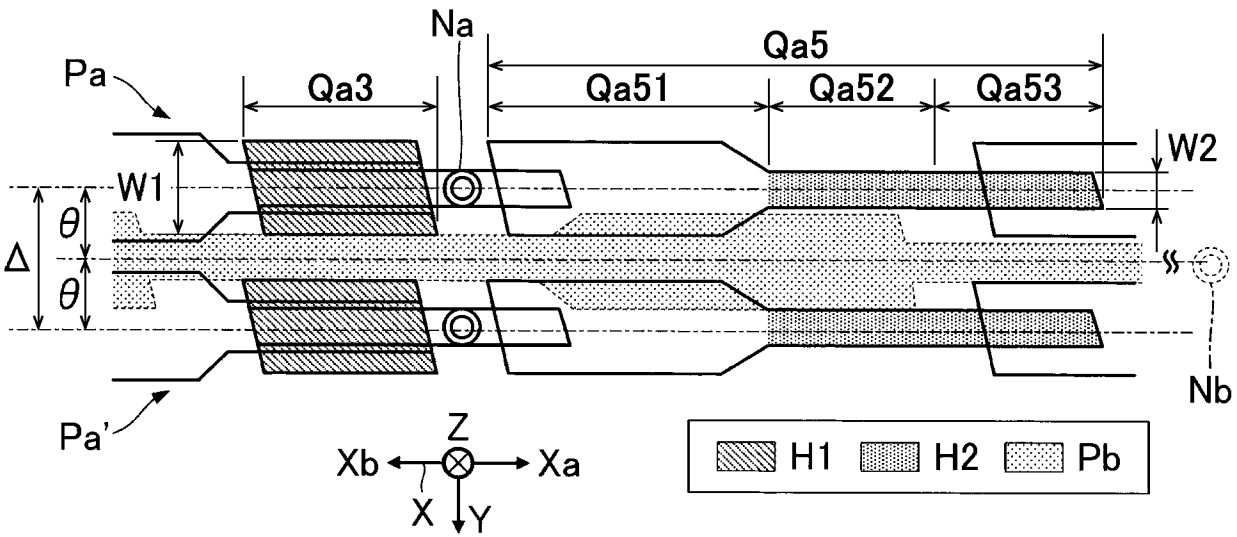
FIG. 10 is a schematic view of a first local flow path and a second local flow path.

FIG. 10 is an enlarged plan view of the first local flow path H1 and the second local flow path H2. As described above, in the first embodiment, the first local flow path H1 is disposed at a low density and the second local flow path H2 is disposed at a high density. For the first local flow path H1 disposed at a low density, it is possible to select a design that secures a sufficient flow path width. Specifically, as illustrated in FIG. 10, it is possible to adopt a configuration in which a maximum width W1 of the first local flow path H1 is larger than a maximum width W2 of the second local flow path H2. The maximum width W1 of the first local flow path H1 is the flow path width of the third flow path Qa3 of the first individual flow path Pa. On the other hand, the maximum width W2 of the second local flow path H2 is the flow path width of the portion Qa52 and the portion Qb53 of the fifth flow path Qa5 of the first individual flow path Pa.

According to the configuration in which the maximum width W1 of the first local flow path H1 exceeds the maximum width W2 of the second local flow path H2 as described above, the flow path width of the first local flow path H1 is sufficiently secured. Therefore, there is an advantage that the flow path resistance of the first local flow path H1 can be effectively reduced.

In FIG. 10, in addition to the first individual flow path Pa and the second individual flow path Pb that are adjacent to each other in the Y-axis direction, a first individual flow path Pa' adjacent to the second individual flow path Pb on the side opposite to the first individual flow path Pa is also shown. That is, the second individual flow path Pb is positioned between the first individual flow path Pa and the first individual flow path Pa'. The first individual flow path Pa' is an example of the "third individual flow path".

FIG. 10 illustrates a pitch Δ of the first individual flow paths Pa in the Y-axis direction. The pitch Δ is a distance between center lines of the first individual flow path Pa and the first individual flow path Pa'. The pitch Δ corresponds to twice a pitch θ of the plurality of nozzles N including the nozzle Na and the nozzle Nb (Δ=2θ). The maximum width W1 of the above-described first local flow path H1 is larger than half (Δ/2) of the pitch Δ between the first individual flow path Pa and the first individual flow path Pa'. It may be said that the maximum width W1 of the first local flow path H1 exceeds the pitch θ of the plurality of nozzles N. According to the above configuration, since the flow path width of the first local flow path H1 is sufficiently secured, the flow path resistance of the first local flow path H1 can be effectively reduced.

In the above description, the first individual flow path Pa was focused on, but the same configuration is established for the second individual flow path Pb. For example, the third local flow path H3 illustrated in FIG. 9 is a portion of the second individual flow path Pb that causes the pressure chamber Cb and the nozzle Nb to communicate with each other. Specifically, the third local flow path H3 is composed of the second flow path Qb22, the third flow path Qb3, and the portion Qb41 of the fourth flow path Qb4 of the second individual flow path Pb. As understood from FIG. 9, the third local flow path H3 does not overlap the first individual flow path Pa when viewed in the Y-axis direction. Therefore, the third local flow path H3 can be disposed at a low density in the Y-axis direction. Further, the pressure chamber Cb in the second individual flow path Pb does not overlap the first individual flow path Pa when viewed in the Y-axis direction. Therefore, the pressure chamber Cb can be disposed at a low density in the Y-axis direction.

The fourth local flow path H4 illustrated in FIG. 9 is a portion of the second individual flow path Pb that overlaps the first individual flow path Pa when viewed in the Y-axis direction. Specifically, the fourth local flow path H4 is composed of a portion Qb52 and a portion Qb53 of the fifth flow path Qb5 of the second individual flow path Pb. The fourth local flow path H4 overlaps the portions Qa52 and Qa53 of the fifth flow path Qa5 of the first individual flow path Pa when viewed in the Y-axis direction. That is, the individual flow path P is disposed at a high density in the portion corresponding to the fourth local flow path H4.

A2: Second Feature

Figure 11:
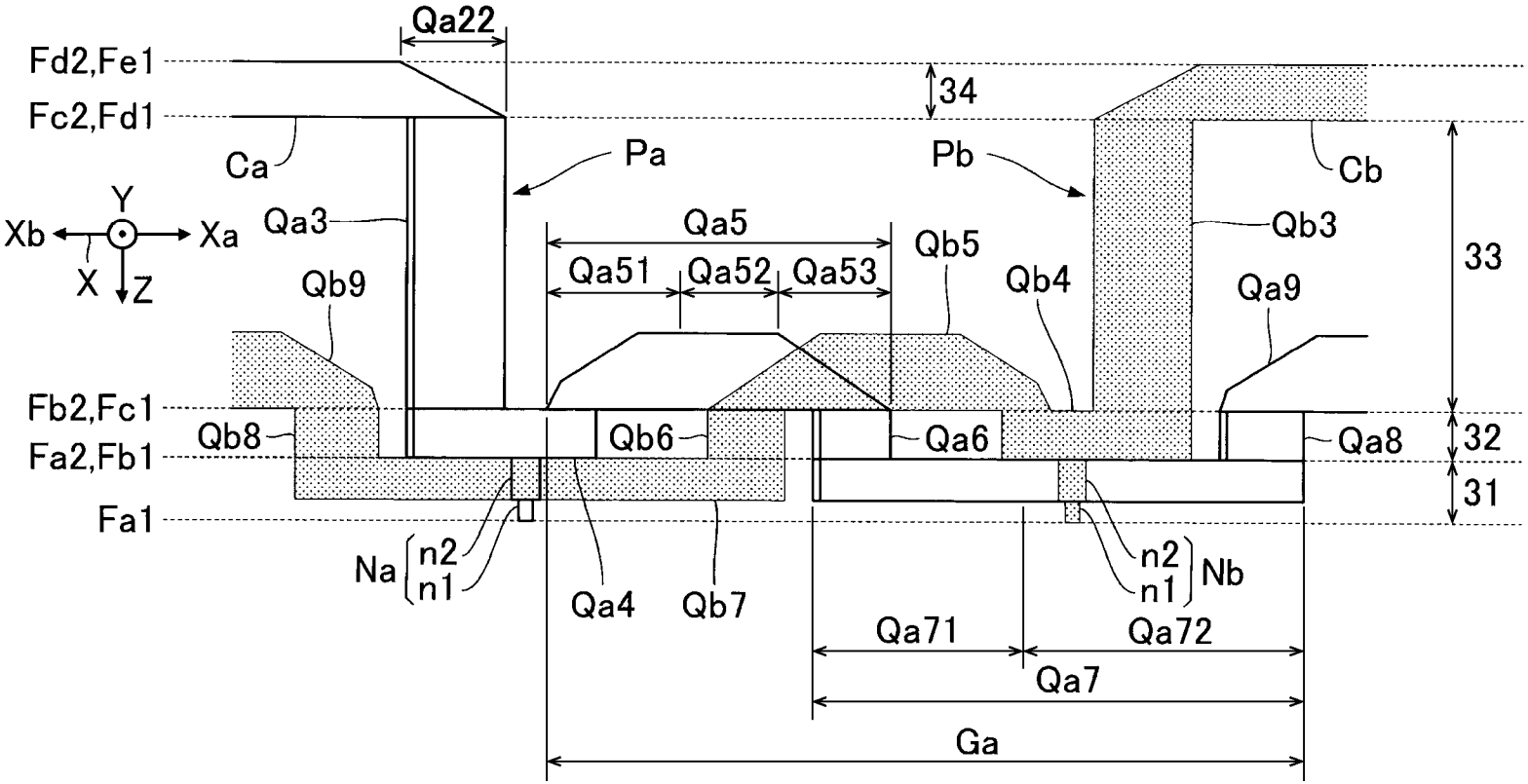
FIG. 11 is a partially enlarged side view of a first individual flow path.
Figure 12:
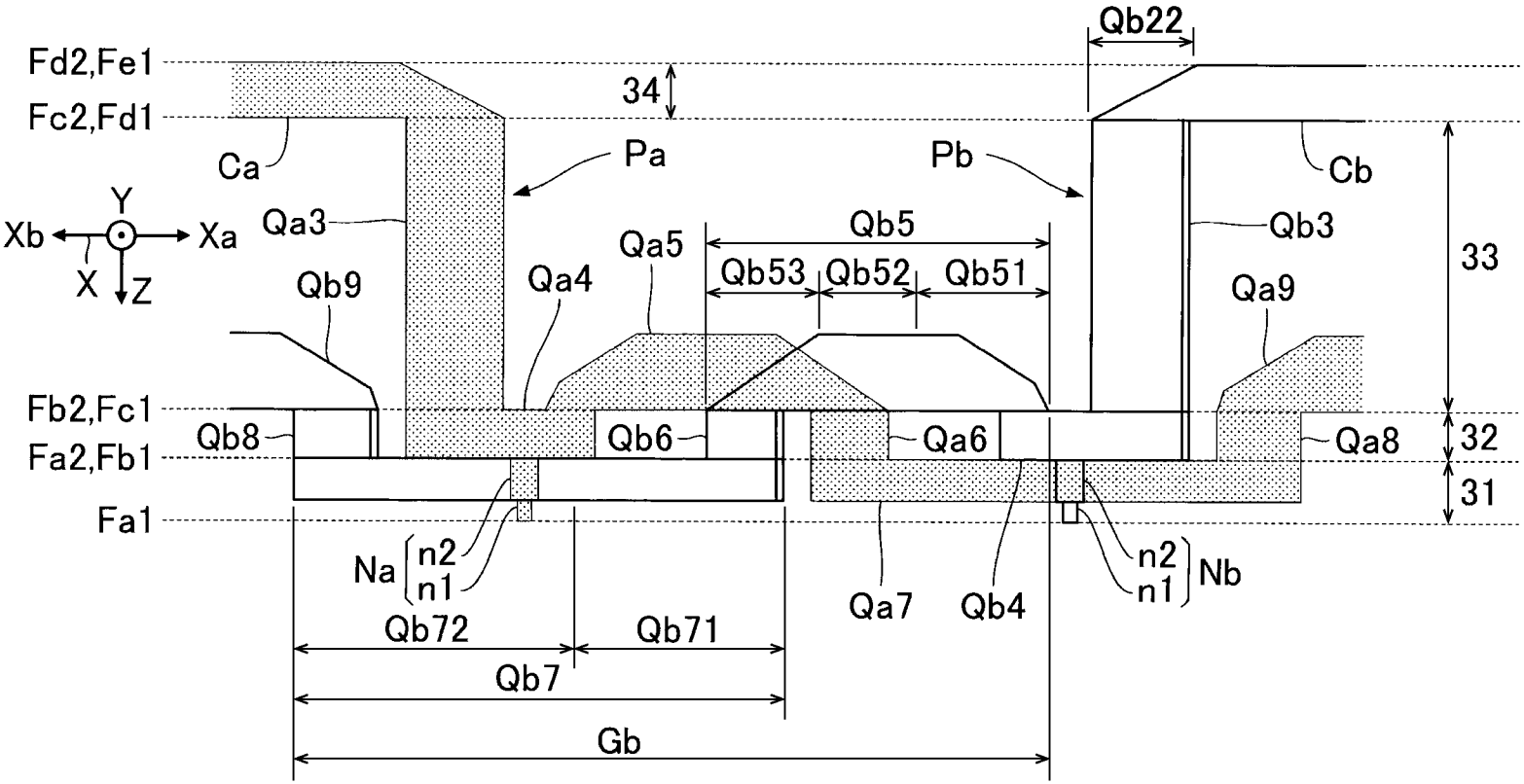
FIG. 12 is a partially enlarged side view of a second individual flow path.

FIG. 11 is a side view of the first individual flow path Pa, and FIG. 12 is a side view of the second individual flow path Pb. In FIG. 11, the outer shape of the second individual flow path Pb is shown in a shaded manner, and in FIG. 12, the outer shape of the first individual flow path Pa is shown in a shaded manner.

As illustrated in FIGS. 11 and 12, the seventh flow path Qa7 of the first individual flow path Pa and the seventh flow path Qb7 of the second individual flow path Pb are installed on the common nozzle plate 31 together with the nozzles Na and Nb. According to the above configuration, the configuration of the liquid ejecting head 24 is simplified as compared with the configuration in which the seventh flow path Qa7 and the seventh flow path Qb7 are installed on the separate substrate from the nozzle Na and the nozzle Nb. Note that, the seventh flow path Qa7 is an example of the "fifth local flow path", and the seventh flow path Qb7 is an example of the "sixth local flow path".

As described above, the seventh flow path Qa7 of the first individual flow path Pa communicates with the nozzle Na via the sixth flow path Qa6, the fifth flow path Qa5, and the fourth flow path Qa4. That is, the seventh flow path Qa7 indirectly communicates with the nozzle Na via a flow path formed in a member other than the nozzle plate 31 (specifically, the first flow path substrate 32 and the second flow path substrate 33). As understood from FIGS. 6 and 7, a groove or a recess that causes the seventh flow path Qa7 and the nozzle Na to communicate with each other is not formed on the surface (Fa1 and Fa2) or the inside of the nozzle plate 31. That is, the seventh flow path Qa7 and the nozzle Na do not directly communicate with each other in the nozzle plate 31.

Similarly, the seventh flow path Qb7 of the second individual flow path Pb communicates with the nozzle Nb via the sixth flow path Qb6, the fifth flow path Qb5, and the fourth flow path Qb4, as described above. That is, the seventh flow path Qb7 indirectly communicates with the nozzle Nb via a flow path formed in a member other than the nozzle plate 31. As understood from FIGS. 6 and 7, a groove or a recess that causes the seventh flow path Qb7 and the nozzle Nb to communicate with each other is not formed on the surface (Fa1 and Fa2) or the inside of the nozzle plate 31. That is, the seventh flow path Qb7 and the nozzle Nb do not directly communicate with each other in the nozzle plate 31.

As understood from FIG. 11, the seventh flow path Qa7 of the first individual flow path Pa overlaps the nozzle Nb communicating with the second individual flow path Pb when viewed in the Y-axis direction. Specifically, the seventh flow path Qa7 overlaps the second section n2 of the nozzle Nb when viewed in the Y-axis direction. The seventh flow path Qa7 does not overlap the first section n1 of the nozzle Nb when viewed in the Y-axis direction. As described above, in the first embodiment, the seventh flow path Qa7 of the first individual flow path Pa and the nozzle Nb communicating with the second individual flow path Pb overlap in the Y-axis direction. Therefore, the seventh flow path Qa7 can be disposed at a low density in the Y-axis direction. Since the nozzle N has a smaller diameter than the individual flow path P, an occupying width of the nozzle N in the Y-axis direction is small. Therefore, a degree of freedom in designing the flow path width of the seventh flow path Qa7 and the thickness of a side wall defining the seventh flow path Qa7 does not excessively decrease.

Similarly, the seventh flow path Qb7 of the second individual flow path Pb overlaps the nozzle Na communicating with the first individual flow path Pa when viewed in the Y-axis direction, as illustrated in FIG. 12. Specifically, the seventh flow path Qb7 overlaps the second section n2 of the nozzle Na when viewed in the Y-axis direction. The seventh flow path Qb7 does not overlap the first section n1 of the nozzle Na when viewed in the Y-axis direction. As described above, in the first embodiment, the seventh flow path Qb7 of the second individual flow path Pb and the nozzle Na communicating with the first individual flow path Pa overlap in the Y-axis direction. Therefore, the seventh flow path Qb7 can be disposed at a low density in the Y-axis direction. As understood from FIGS. 11 and 12, the nozzle Na and the nozzle Nb do not overlap when viewed in the Y-axis direction.

Here, a configuration having a flow path (hereinafter, referred to as a "direct communication path") that causes the seventh flow path Qa7 and the nozzle Na to directly communicate with each other in the nozzle plate 31 is assumed as a comparative example of the first embodiment. Since the nozzle Na and the seventh flow path Qb7 overlap when viewed in the Y-axis direction as described above, in the comparative example, the direct communication path and a portion of the seventh flow path Qb7 (at least in the vicinity of the nozzle Na) also overlap in the Y-axis direction. That is, it is inevitable that the direct communication path and a portion of the seventh flow path Qb7 have a high-density flow path disposition. The configuration in which the seventh flow path Qa7 and the nozzle Na do not directly communicate with each other in the nozzle plate 31 as in the first embodiment is preferable for avoiding the above problem. Note that, the reason why the configuration in which the seventh flow path Qb7 and the nozzle Nb do not directly communicate with each other in the nozzle plate 31 in the first embodiment is adopted is also the same.

The first section n1 of the nozzle Na and the first section n1 of the nozzle Nb are formed by etching the surface Fa1 of the plate-shaped member that becomes the nozzle plate 31. On the other hand, the seventh flow path Qa7, the seventh flow path Qb7, and the second sections n2 of the nozzle Na and the nozzle Nb are collectively formed by etching the surface Fa2 of the plate-shaped member. The first section n1 formed from the surface Fa1 and the second section n2 formed from the surface Fa2 communicate with each other to form the nozzle N. Therefore, the seventh flow path Qa7, the seventh flow path Qb7, and the second section n2 of each nozzle N are formed to have the same depth. As can be understood from the above description, according to the first embodiment, the seventh flow path Qa7, the seventh flow path Qb7, and the second section n2 of each nozzle N can be collectively formed by a step of selectively removing a portion of the plate-shaped member in the thickness direction, the plate-shaped member being the material of the nozzle plate 31. Further, as described above, since the seventh flow path Qa7 and the seventh flow path Qb7 and the first section n1 of each nozzle N are formed by etching in the opposite direction in a separate step, they do not overlap when viewed in the Y-axis direction as described above. As can be understood from the above description, according to the first embodiment, the nozzle plate 31 can be formed by a simple step including one etching on the surface Fa1 and one etching on the surface Fa2 of the plate-shaped member.

By the way, in order to provide the seventh flow path Qa7 and the seventh flow path Qb7 in the nozzle plate 31, in order to secure the depth of the flow path and the thickness of the bottom wall configuring the flow path, the nozzle plate 31 itself needs to have a certain thickness. However, when the nozzle plate 31 having such a thickness is used and the entire nozzle N is configured by only the small-diameter first section n1, the flow path resistance and the inertance of the nozzle N increase, and thus the ink ejection efficiency decreases. On the other hand, when the entire nozzle N is configured only by the large-diameter second section n2, the ink ejection speed decreases. When the nozzle N is configured by a two-stage structure of the first section n1 and the second section n2 as in the first embodiment, it is possible to maintain the ejection speed with the first section n1, and suppress the decrease in ejection efficiency with the second section n2. That is, the two-stage structure of the nozzle N suppresses the deterioration of an ejection performance. On the other hand, according to the configuration in which the seventh flow path Qa7 and the seventh flow path Qb7 are formed in the nozzle plate 31, as described above, the seventh flow path Qa7 and the seventh flow path Qb7 can be disposed at a low density in the Y-axis direction. As can be understood from the above description, according to the first embodiment, there is an effect that the structure that contributes to the low-density disposition of the flow path and the two-stage structure capable of avoiding the deterioration of the ejection performance can be collectively formed by a common step.

A3: Third Feature

As illustrated in FIG. 11, the first individual flow path Pa includes a first partial flow path Ga. The first partial flow path Ga includes a seventh flow path Qa7, a sixth flow path Qa6, and a fifth flow path Qa5. Each of the seventh flow path Qa7 and the fifth flow path Qa5 is a flow path extending along the X axis. The sixth flow path Qa6 is a flow path that causes the seventh flow path Qa7 and the fifth flow path Qa5 to communicate with each other. As understood from FIG. 11, the seventh flow path Qa7 is formed in a layer closer to the surface Fa1 of the nozzle plate 31 than the sixth flow path Qa6 and the fifth flow path Qa5. Note that, the seventh flow path Qa7 is an example of a "seventh local flow path", the sixth flow path Qa6 is an example of a "ninth local flow path", and the fifth flow path Qa5 is an example of an "eighth local flow path". Further, the surface Fa1 of the nozzle plate 31 is an example of an "ejecting surface".

As illustrated in FIG. 12, the second individual flow path Pb includes a second partial flow path Gb. The second partial flow path Gb includes a seventh flow path Qb7, a sixth flow path Qb6, and a fifth flow path Qb5, like the first partial flow path Ga. Each of the seventh flow path Qb7 and the fifth flow path Qb5 is a flow path extending along the X axis. The sixth flow path Qb6 is a flow path that causes the seventh flow path Qb7 and the fifth flow path Qb5 to communicate with each other. As understood from FIG. 12, the seventh flow path Qb7 is formed in a layer closer to the surface Fa1 of the nozzle plate 31 than the sixth flow path Qb6 and the fifth flow path Qb5. Note that, the seventh flow path Qb7 is an example of a "tenth local flow path", the sixth flow path Qb6 is an example of a "twelfth local flow path", and the fifth flow path Qb5 is an example of an "eleventh local flow path".

As understood from FIGS. 11 and 12, the first partial flow path Ga and the second partial flow path Gb do not partially overlap when viewed in the Y-axis direction. That is, the first partial flow path Ga and the second partial flow path Gb partially overlap when viewed in the Y-axis direction. Specifically, a portion of the fifth flow path Qa5 (portions Qa52 and Qa53) of the first partial flow path Ga and a portion of the fifth flow path Qb5 (portions Qb52 and Qb53) of the second partial flow path Gb overlap when viewed in the Y-axis direction, and the other portions of the first partial flow path Ga and the other portions of the second partial flow path Gb do not overlap in the Y-axis direction. For example, the seventh flow path Qa7 of the first individual flow path Pa and the fifth flow path Qb5 of the second individual flow path Pb do not overlap when viewed in the Y-axis direction. Further, the fifth flow path Qa5 of the first individual flow path Pa and the seventh flow path Qb7 of the second individual flow path Pb do not overlap when viewed in the Y-axis direction. According to the above configuration, portions of the first partial flow path Ga and the second partial flow path Gb that do not overlap when viewed in the Y-axis direction can be disposed at a low density in the Y-axis direction.

For example, it is assumed that the first partial flow path Ga and the second partial flow path Gb are configured by only a single-layer flow path formed in the nozzle plate 31, as a comparative example. In the comparative example, most of the first partial flow path Ga and the second partial flow path Gb overlap in the Y-axis direction. Therefore, it is difficult to reduce the range in which the flow path is disposed at a high density. In contrast to the above-described comparative example, in the first embodiment, each of the first partial flow path Ga and the second partial flow path Gb is composed of a plurality of layers of flow paths, and therefore the difference between the layers is used. As a result, the range in which the first partial flow path Ga and the second partial flow path Gb overlap in the Y-axis direction (that is, the range in which the flow path is disposed at a high density) is reduced. Specifically, it is possible to adopt a configuration in which only a portion (Qa52 and Qa53) of the fifth flow path Ga5 of the first partial flow path Ga and a portion (Qb52 and Qb53) of the fifth flow path Gb5 of the second partial flow path Gb overlap when viewed in the Y-axis direction. On the other hand, a portion Qa51 of the fifth flow path Ga5 of the first partial flow path Ga, a sixth flow path Ga6 and a seventh flow path Gal, a portion Qb51 of the fifth flow path Gb5 of the second partial flow path Gb, and the sixth flow path Gb6 and the seventh flow path Gb7 do not overlap when viewed in the Y-axis direction. Therefore, according to the first embodiment, there is an advantage that the range in which the flow path can be disposed at a low density can be sufficiently secured.

As understood from FIGS. 11 and 12, the sixth flow path Qa6 of the first partial flow path Ga and the sixth flow path Qb6 of the second partial flow path Gb do not overlap when viewed in the Y-axis direction. A configuration in which the sixth flow path Qa6 of the first partial flow path Ga and the sixth flow path Qb6 of the second partial flow path Gb overlap when viewed in the Y-axis direction is assumed as a comparative example. In the comparative example, the range in which the flow path is disposed at a high density extends not only to a portion of the sixth flow path Qa6, but also to a portion of the fifth flow path Qa5 and a portion of the seventh flow path Qa7 coupled to the sixth flow path Qa6. Similarly, in the comparative example, the range in which the flow path is disposed at a high density extends not only to a portion of the sixth flow path Qb6, but also to a portion of the fifth flow path Qb5 and a portion of the seventh flow path Qb7 coupled to the sixth flow path Qb6. That is, a ratio of the sections of the individual flow path P which is disposed at a high density in the Y-axis direction increases. In the first embodiment, since the sixth flow path Qa6 and the sixth flow path Qb6 do not overlap when viewed in the Y-axis direction, it is possible to reduce the ratio of the sections of each individual flow path P which is disposed at a high density in the Y-axis direction. For example, the seventh flow path Qa7 and the seventh flow path Qb7 do not overlap when viewed in the Y-axis direction.

As can be understood from FIGS. 11 and 12, the fifth flow path Qa5 positioned in the upper layer of the first individual flow path Pa is closer to the first common liquid chamber R1 than the sixth flow path Qa6 and the seventh flow path Qa7, with respect to the direction of a streamline axis in the first individual flow path Pa. Note that "close" to the direction of the streamline axis means that the distance measured along the streamline axis of the flow path is small. Further, the seventh flow path Qb7 positioned in the lower layer of the second individual flow path Pb is closer to the first common liquid chamber R1 than the fifth flow path Qb5 and the sixth flow path Qb6, with respect to the direction of the streamline axis in the second individual flow path Pb. On the other hand, the seventh flow path Qa7 positioned in the lower layer of the first individual flow path Pa is closer to the second common liquid chamber R2 than the fifth flow path Qa5 and the sixth flow path Qa6, with respect to the direction of the streamline axis in the first individual flow path Pa. Further, the fifth flow path Qb5 positioned in the upper layer of the second individual flow path Pb is closer to the second common liquid chamber R2 than the sixth flow path Qb6 and the seventh flow path Qb7, with respect to the direction of the streamline axis in the second individual flow path Pb.

In the above configuration, for convenience sake, the direction of the individual flow paths P will be considered with the position close to the first common liquid chamber R1 with respect to the direction of the streamline axis when viewed from, for example, an optional point in the individual flow path P as the upstream, and the position close to the second common liquid chamber R2 as the downstream. In the first individual flow path Pa, the portion (Qa5) in the upper layer is positioned on the upstream, and the portion (Qa7) in the lower layer is positioned on the downstream. On the other hand, in the second individual flow path Pb, the portion (Qb5) in the upper layer is positioned on the downstream and the portion (Qb7) in the lower layer is positioned on the upstream. By adopting a layout exemplified above, it is possible to prevent the flow paths of the same layer from being adjacent to each other between the first individual flow path Pa and the second individual flow path Pb. Therefore, there is an advantage that it is easy to realize a low flow path density.

As described above, the seventh flow path Qa7 and the seventh flow path Qb7 are formed in the common nozzle plate 31 together with the nozzle Na and the nozzle Nb. The seventh flow path Qa7 and the seventh flow path Qb7 do not overlap when viewed in the Y-axis direction. According to the above configuration, each of the seventh flow path Qa7 and the seventh flow path Qb7 can be disposed at a low density in the Y-axis direction. Generally, since the thickness of the nozzle plate 31 is determined according to the target ejection characteristic, it is difficult to secure a sufficient thickness for forming the flow path in the nozzle plate 31. When the seventh flow path Qa7 and the seventh flow path Qb7 overlap when viewed in the Y-axis direction in a case where the nozzle plate 31 is sufficiently thin as described above, it is difficult to secure a sufficient flow path cross-sectional area for the seventh flow path Qa7 and the seventh flow path Qb7. According to the first embodiment, since the seventh flow path Qa7 and the seventh flow path Qb7 do not overlap when viewed in the Y-axis direction, each of the seventh flow path Qa7 and the seventh flow path Qb7 can be disposed at a low density in the Y-axis direction. Therefore, even in a configuration in which the nozzle plate 31 is sufficiently thin, there is an advantage that the flow path cross-sectional areas of the seventh flow path Qa7 and the seventh flow path Qb7 can be easily secured.

A4: Fourth Feature

As understood from the plan views of FIGS. 8 and 9, the first individual flow path Pa includes a flow path that partially overlaps the second individual flow path Pb in plan view from the Z-axis direction (hereinafter, referred to as an "overlapping flow path"), and a flow path that does not overlap the second individual flow path Pb in plan view (hereinafter, referred to as a "non-overlapping flow path"). The overlapping flow path has a lower flow path density than the density of the plurality of nozzles N in the Y-axis direction (nozzle density). That is, the overlapping flow path is a flow path disposed at a low density in the Y-axis direction. On the other hand, the non-overlapping flow path is a flow path formed with a high density equivalent to that of the plurality of nozzles N.

The overlapping flow path includes the pressure chamber Ca, the third flow path Qa3, the portion Qa51 of the fifth flow path Qa5, the portion Qa71 of the seventh flow path Qa7, and the ninth flow path Qa9 of the first individual flow path Pa. Since the overlapping flow path overlaps the second individual flow path Pb in plan view, the overlapping flow path does not overlap the second individual flow path Pb when viewed in the Y-axis direction. The overlapping flow paths (Ca, Qa3, Qa51, Qa71, and Qa9) are an example of a "thirteenth local flow path". As described above, in the first embodiment, the first individual flow path Pa includes the overlapping flow path that partially overlaps the second individual flow path Pb in plan view.

As a comparative example with respect to the first embodiment, a configuration in which the first individual flow path Pa and the second individual flow path Pb are disposed at a high density is assumed. In the comparative example, for example, when one flow path width of the first individual flow path Pa and the second individual flow path Pb is widened, there is no choice but to narrow the other flow path width so that the flow paths do not interfere with each other, and there is a problem that the increase in flow path resistance and inertance at that portion cannot be avoided. The presence of the overlapping flow path as in the first embodiment means that the flow path width of the first individual flow path Pa or the second individual flow path Pb is widened beyond an interference limit between the flow paths in the comparative example. Therefore, there is an advantage that the flow path resistance or the inertance of the individual flow path row 25 can be reduced. Particularly in the first embodiment, the overlapping flow path includes the first local flow path H1 and the pressure chamber Ca. Specifically, the first local flow path H1 and the pressure chamber Ca are widened so as to overlap the second individual flow path Pb when viewed in the Z-axis direction. As a result, the flow path resistance and the inertance in the first local flow path H1 are reduced, and the excluded volume of the pressure chamber Ca is increased, thereby realizing an excellent ink ejection characteristic.

On the other hand, the non-overlapping flow path includes the second flow path Qa22, the fourth flow path Qa4, the portions Qa52 and Qa53 of the fifth flow path Qa5, the sixth flow path Qa6, the portion Qa72 of the seventh flow path Qa7, and the eighth flow path Qa8 of the first individual flow path Pa. Since the non-overlapping flow path does not overlap the second individual flow path Pb in plan view, the non-overlapping flow path is allowed to overlap the second individual flow path Pb when viewed in the Y-axis direction. For example, as described above, the portion Qa52 and the portion Qa53 of the fifth flow path Qa5 of the non-overlapping flow path overlap the second individual flow path Pb when viewed in the Y-axis direction. The non-overlapping flow paths (Qa22, Qa4, Qa52, Qa53, Qa6, Qa72, and Qa8) are an example of a "fourteenth local flow path". The non-overlapping flow path of the first individual flow path Pa is disposed at a high density in the Y-axis direction. Therefore, the limited space in the liquid ejecting head 24 can be efficiently used for forming the flow path. As described above, the first individual flow path Pa of the first embodiment includes both the overlapping flow path and the non-overlapping flow path. Therefore, it is possible to reduce the overall flow path resistance of the first individual flow path Pa by the overlapping flow path and at the same time, it is possible to partially densify the flow paths by the non-overlapping flow paths.

As exemplified above, since the overlapping flow path overlaps the second individual flow path Pb, the maximum width of the overlapping flow path is larger than the maximum width of the non-overlapping flow path. Specifically, the maximum width of the overlapping flow path is larger than half (Δ/2) of the pitch Δ described with reference to FIG. 10. On the other hand, the maximum width of the non-overlapping flow path is smaller than half (Δ/2) of the pitch Δ. According to the above configuration, since the flow path width of the overlapping flow path is sufficiently secured, the flow path resistance of the overlapping flow path can be effectively reduced.

Although the first individual flow path Pa is focused on in the above description, the same configuration is established for the second individual flow path Pb. Specifically, the second individual flow path Pb includes an overlapping flow path that partially overlaps the first individual flow path Pa in plan view and a non-overlapping flow path that does not overlap the first individual flow path Pa in plan view.

The overlapping flow path of the second individual flow path Pb includes the pressure chamber Cb, the third flow path Qb3, the portion Qb51 of the fifth flow path Qb5, the portion Qb71 of the seventh flow path Qb7, and the ninth flow path Qb9. The overlapping flow paths (Cb, Qb3, Qb51, Qb71, and Qb9) of the second individual flow path Pb are an example of a "fifteenth local flow path". In the above configuration, as described above regarding the overlapping flow path of the first individual flow path Pa, the flow path width of the first individual flow path Pa or the second individual flow path Pb is widened beyond the interference limit between the flow paths. Therefore, there is an advantage that the flow path resistance or the inertance of the individual flow path row 25 can be reduced. Particularly in the first embodiment, the overlapping flow path includes the third local flow path H3 and the pressure chamber Cb. Specifically, the third local flow path H3 and the pressure chamber Cb are widened so as to overlap the second individual flow path Pb when viewed in the Z-axis direction. As a result, the flow path resistance and the inertance in the third local flow path H3 are reduced, and the excluded volume of the pressure chamber Cb is increased, thereby realizing an excellent ink ejection characteristic.

On the other hand, the non-overlapping flow path includes the second flow path Qb22, the fourth flow path Qb4, the portions Qb52 and Qb53 of the fifth flow path Qb5, the sixth flow path Qb6, the portion Qb72 of the seventh flow path Qb7, and the eighth flow path Qb8 of the second individual flow path Pb. The configuration in which the maximum width of the overlapping flow path is larger than the maximum width of the non-overlapping flow path is similar to that of the first individual flow path Pa. As described above, the second individual flow path Pb of the first embodiment includes both the overlapping flow path and the non-overlapping flow path. Therefore, it is possible to reduce the overall flow path resistance of the second individual flow path Pb by the overlapping flow path and at the same time, it is possible to partially densify the flow paths by the non-overlapping flow paths.

B: Second Embodiment

A second embodiment of the present disclosure will be described. In addition, regarding the elements having the same functions as those in the first embodiment in each of the embodiments exemplified below, the reference numerals used in the description of the first embodiment are used, and the detailed description of each is appropriately omitted.

Figure 13:
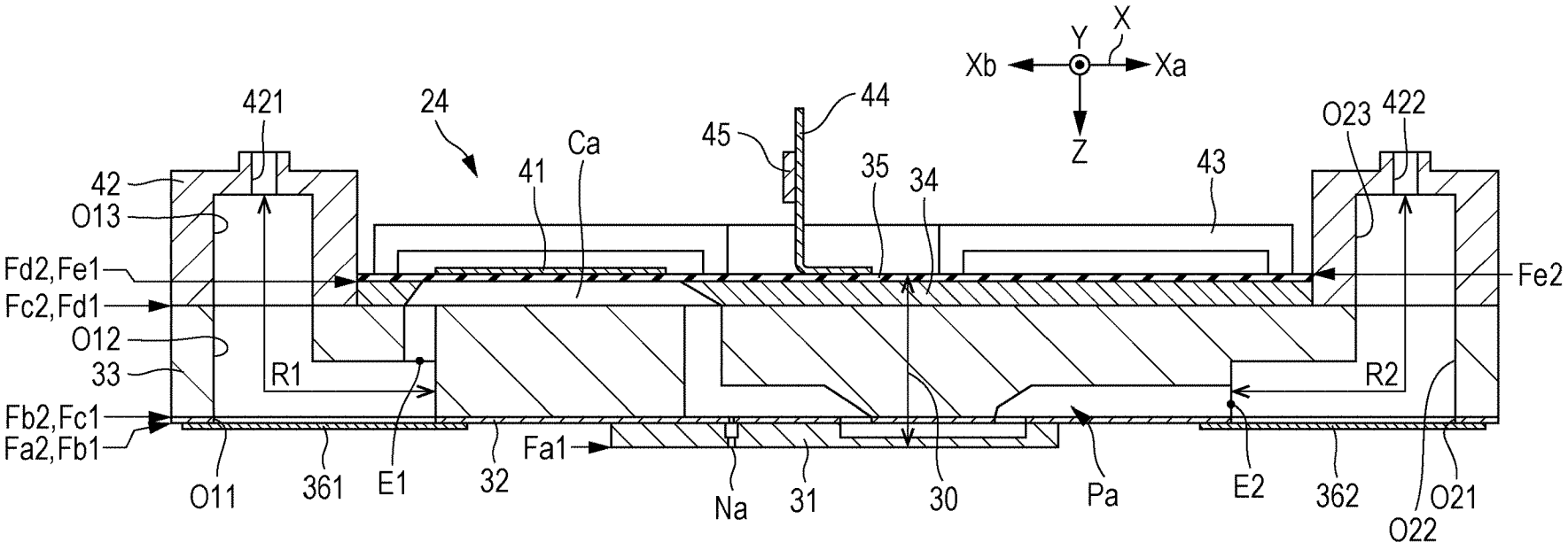
FIG. 13 is a sectional view of a liquid ejecting head according to a second embodiment.
Figure 14:
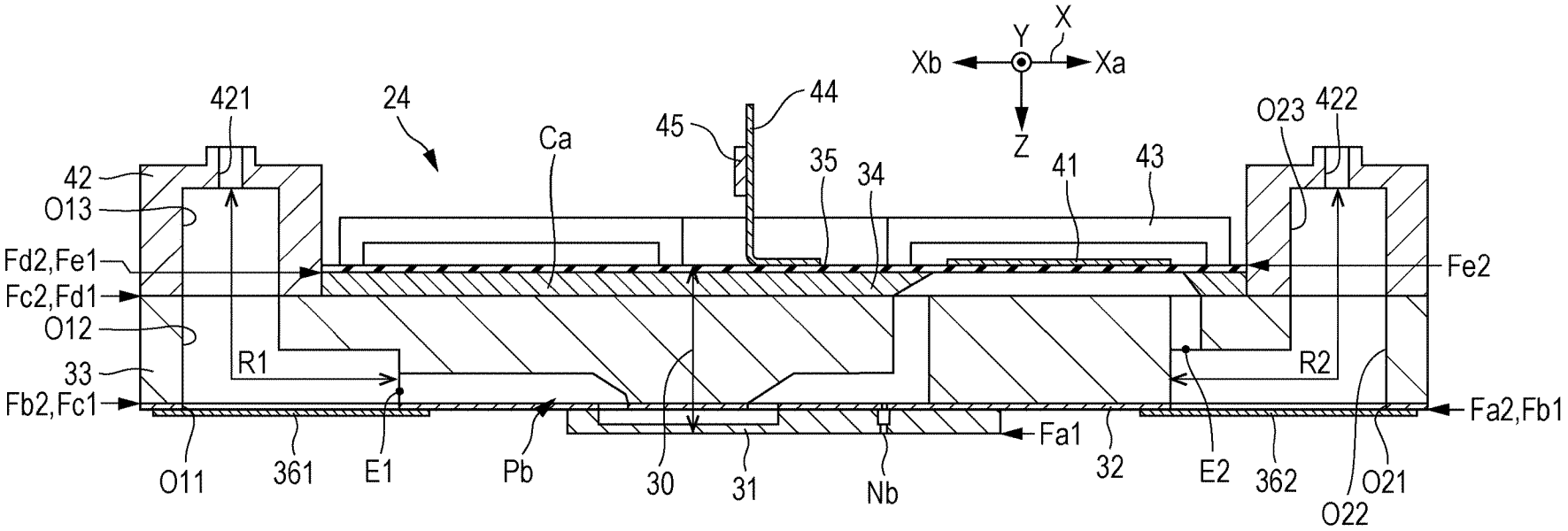
FIG. 14 is a sectional view of a liquid ejecting head according to a second embodiment.

FIGS. 13 and 14 are sectional views of the liquid ejecting head 24 according to the second embodiment. A cross-section passing through the first individual flow path Pa of the individual flow path row 25 is illustrated in FIG. 13, and a cross-section passing through the second individual flow path Pb is illustrated in FIG. 14. As illustrated in FIGS. 13 and 14, in the second embodiment, the first flow path substrate 32 that is sufficiently thinner compared to the first embodiment is used. Note that, the second embodiment differs from the first embodiment only in the first flow path substrate 32 and the second flow path substrate 33, and configurations of other elements including the nozzle plate 31 and the pressure chamber substrate 34 are the same as those in the first embodiment.

Figure 15:
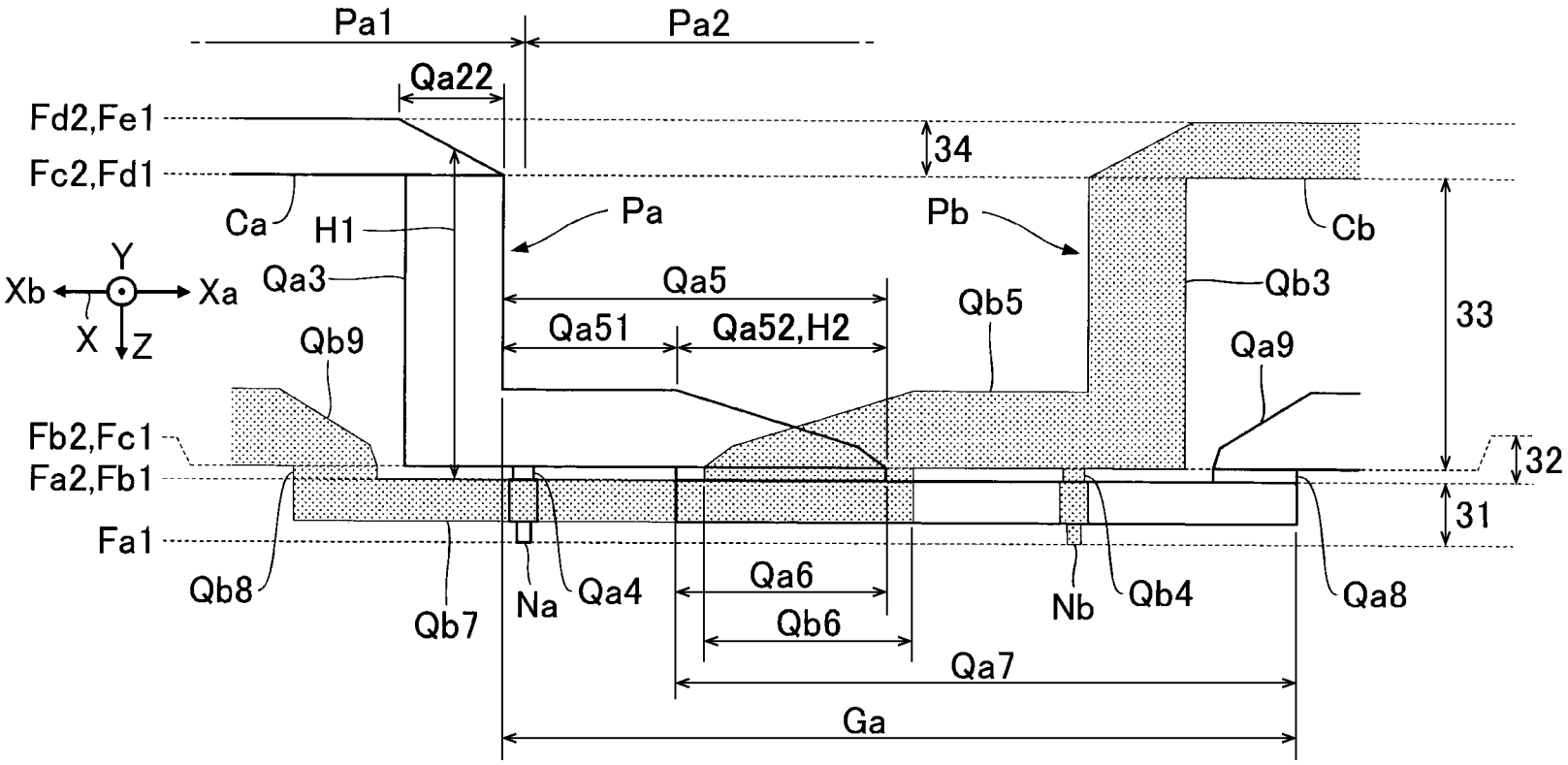
FIG. 15 is a partially enlarged side view of a first individual flow path.
Figure 16:
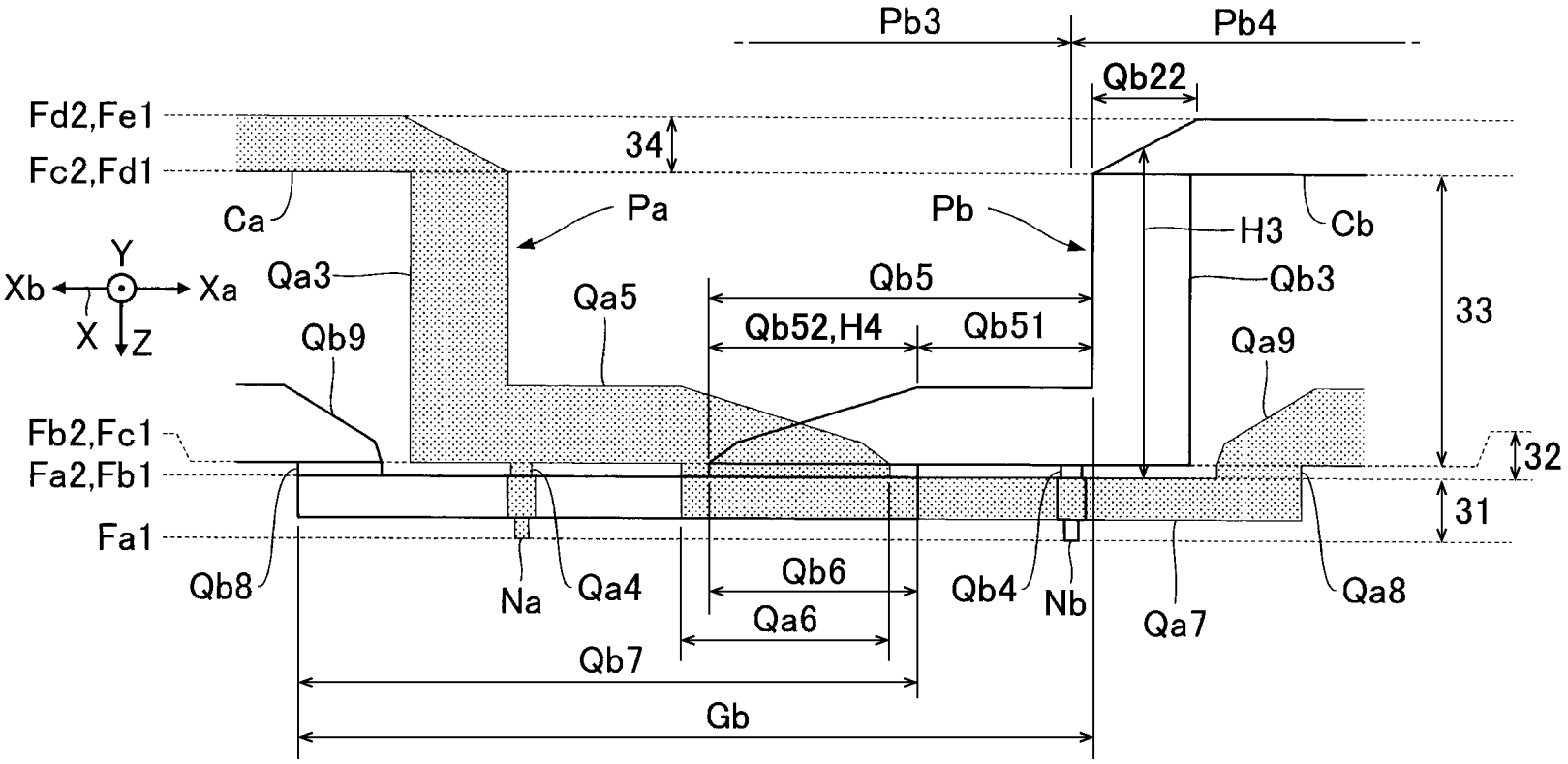
FIG. 16 is a partially enlarged side view of a second individual flow path.
Figure 17:
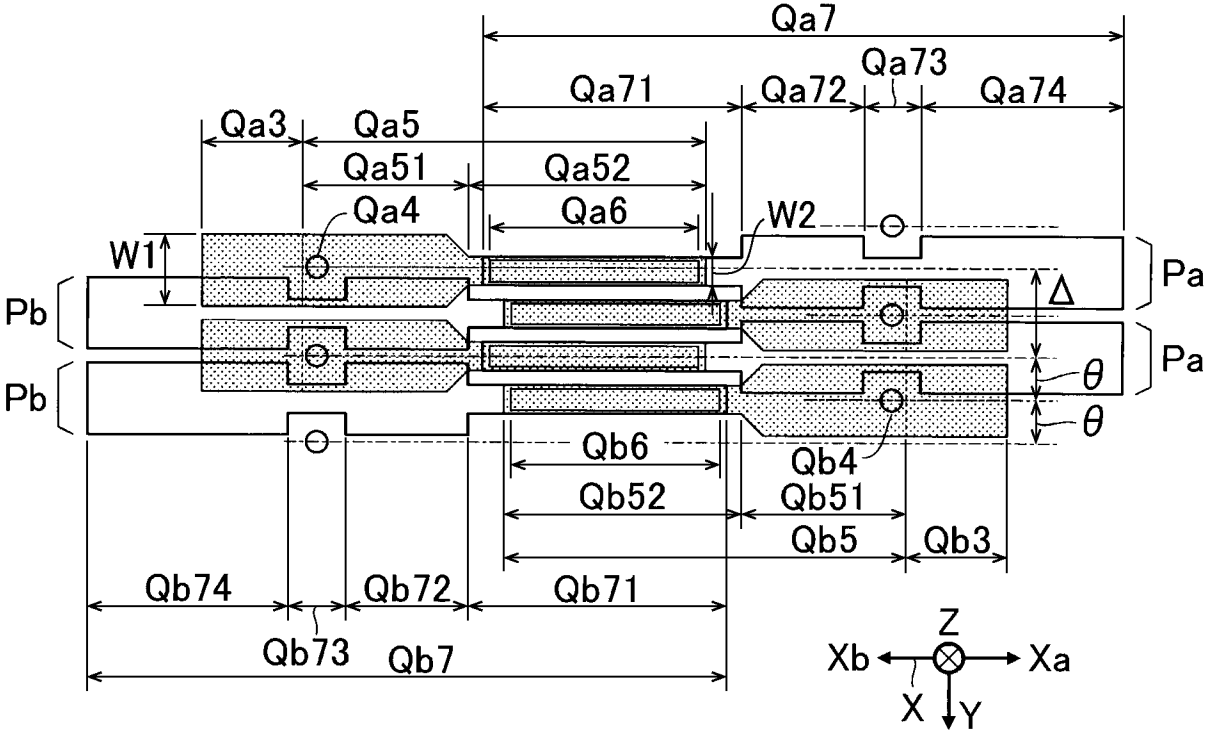
FIG. 17 is a plan view of a first individual flow path and a second individual flow path.

FIG. 15 is a partially enlarged side view of the first individual flow path Pa, and FIG. 16 is a partially enlarged side view of the second individual flow path Pb. In FIG. 15, the outer shape of the second individual flow path Pb is shown in a shaded manner, and in FIG. 16, the outer shape of the first individual flow path Pa is shown in a shaded manner. Further, FIG. 17 is a plan view of portions of the first individual flow path Pa and the second individual flow path Pb illustrated in FIGS. 15 and 16. Note that, in FIG. 17, the third flow path Qa3 and the fifth flow path Qa5, and the third flow path Qb3 and the fifth flow path Qb5 are shaded for convenience.

As illustrated in FIGS. 13 and 15, in the first individual flow path Pa of the second embodiment, the third flow path Qa3 and the fifth flow path Qa5 communicate with each other in the second flow path substrate 33. Specifically, the fifth flow path Qa5 includes the portion Qa51 and the portion Qa52. The portion Qa51 is a flow path that causes the third flow path Qa3 and the portion Qa52 to communicate with each other. The portion Qa51 and the portion Qa52 extend in the X-axis direction. As illustrated in FIG. 17, the flow path width of the portion Qa52 is smaller than the flow path width of the portion Qa51. An upper surface of the portion Qa52 includes an inclined surface of which an edge on the Xb side is higher than an edge on the Xa side. Further, the fourth flow path Qa4 is a flow path that causes the fifth flow path Qa5 and the nozzle Na to communicate with each other. The fourth flow path Qa4 is a through-hole formed in the first flow path substrate 32 with a diameter smaller than that of the second section n2 of the nozzle Na.

As illustrated in FIGS. 14 and 16, similarly in the second individual flow path Pb, the third flow path Qb3 and the fifth flow path Qb5 communicate with each other in the second flow path substrate 33. Specifically, the fifth flow path Qb5 includes the portion Qb51 and the portion Qb52. The portion Qb51 and the portion Qb52 extend in the X-axis direction. As illustrated in FIG. 17, the flow path width of the portion Qb52 is smaller than the flow path width of the portion Qb51. An upper surface of the portion Qb52 includes an inclined surface of which an edge on the Xa side is higher than an edge on the Xb side. Further, the fifth flow path Qb5 and the nozzle Nb communicate with each other via the fourth flow path Qb4 having a diameter smaller than that of the second section n2 of the nozzle Nb.

As illustrated in FIG. 17, the seventh flow path Qa7 installed in the nozzle plate 31 is a flow path in which the portion Qa71, the portion Qa72, the portion Qa73, and the portion Qa74 are coupled in the Xa direction in the above order. The flow path widths of the portions Qa71 and Qa73 are smaller than the flow path widths of the portions Qa72 and Qa74. An end of the portion Qa74 positioned in the Xa direction communicates with the eighth flow path Qa8.

Similarly, the seventh flow path Qb7 configuring the second individual flow path Pb is a flow path in which the portion Qb71, the portion Qb72, the portion Qb73, and the portion Qb74 are coupled in the Xb direction in the above order. The flow path widths of the portions Qb71 and Qb73 are smaller than the flow path widths of the portions Qb72 and Qb74. The end of the portion Qb74 positioned in the Xb direction communicates with the eighth flow path Qb8.

As understood from FIG. 17, the portions Qa71 of the first individual flow paths Pa and the portions Qb71 of the second individual flow paths Pb are alternately arranged along the Y axis. The portions Qa71 and the portions Qb71 are arranged in the Y-axis direction at the pitch θ the same as that of the plurality of nozzles N. On the other hand, the portions Qa72 to Qa74 of the seventh flow path Qa7 in each first individual flow path Pa are arranged in the Y-axis direction at a pitch twice the pitch θ. The fourth flow path Qb4 is formed in the gap of the portion Qa73 between the two seventh flow paths Qa7 adjacent to each other in the Y-axis direction. Similarly, the portions Qb72 to Qb74 of the seventh flow path Qb7 in each second individual flow path Pb are arranged in the Y-axis direction at a pitch twice the pitch θ. The fourth flow path Qa4 is formed in the gap of the portions Qb73 between the two seventh flow paths Qb7 adjacent to each other in the Y-axis direction.

The portion Qa51 of the fifth flow path Qa5 of the first individual flow path Pa overlaps the seventh flow path Qb7 (the portions Qb72 to Qb74) of the second individual flow path Pb adjacent to the first individual flow path Pa in the Y-axis direction in plan view. As described above, a sufficient flow path width is secured for the portion Qa51 of the fifth flow path Qa5. Similarly, the portion Qb51 of the fifth flow path Qb5 of the second individual flow path Pb overlaps the seventh flow path Qa7 (the portions Qa72 to Qa74) of the first individual flow path Pa adjacent to the second individual flow path Pb in the Y-axis direction in plan view. That is, a sufficient flow path width is secured for the portion Qb51 of the fifth flow path Qb5.

The portion Qa52 of the fifth flow path Qa5 of the first individual flow path Pa and a portion Qa71 of the seventh flow path Qa7 of the first individual flow path Pa face each other along the Z axis. The portion Qa52 and the portion Qa71 communicate with each other via the sixth flow path Qa6 positioned between them. The sixth flow path Qa6 is a flow path extending along the X axis. Note that, similar to the first embodiment, the first partial flow path Ga is composed of the seventh flow path Qa7, the sixth flow path Qa6, and the fifth flow path Qa5.

Similarly, the portion Qb52 of the fifth flow path Qb5 of the second individual flow path Pb and the portion Qb71 of the seventh flow path Qb7 of the second individual flow path Pb face each other along the Z axis. The portions Qb52 and Qb71 communicate with each other via the sixth flow path Qb6 positioned between them. The sixth flow path Qb6 is a flow path extending along the X axis. Note that, similar to the first embodiment, the second partial flow path Gb is composed of the seventh flow path Qb7, the sixth flow path Qb6, and the fifth flow path Qb5.

As understood from FIG. 17, the sixth flow paths Qa6 of the first individual flow paths Pa and the sixth flow paths Qb6 of the second individual flow paths Pb are alternately arranged along the Y axis. That is, the sixth flow path Qa6 and the sixth flow path Qb6 overlap when viewed in the Y-axis direction. As described above, the sixth flow path Qa6 is an example of the "ninth local flow path", and the sixth flow path Qb6 is an example of the "twelfth local flow path".

A configuration in which the sixth flow path Qa6 and the sixth flow path Qb6 do not overlap when viewed in the Y-axis direction (for example, the above-described first embodiment) is assumed as a comparative example. In the comparative example, there is no choice but to reduce the ranges of the sixth flow path Qa6 and the sixth flow path Qb6 in the X-axis direction, and the portions become a so-called narrow flow path, which may result in an increase in a flow path resistance of the sixth flow path Qa6 and the sixth flow path Qb6. In the second embodiment, since the sixth flow path Qa6 and the sixth flow path Qb6 are allowed to overlap when viewed from the Y-axis direction, it is easy to secure the ranges of the sixth flow path Qa6 and the sixth flow path Qb6 in the X-axis direction. Therefore, there is an advantage that the flow path resistance in the sixth flow path Qa6 and the sixth flow path Qb6 can be easily reduced. On the other hand, according to the configuration of the first embodiment in which the sixth flow path Qa6 and the sixth flow path Qb6 do not overlap when viewed in the Y-axis direction, as described above, there is an advantage that it is possible to reduce the ratio of the sections of each individual flow path P which is disposed at a high density in the Y-axis direction.

The first portion Pa1 of the first individual flow path Pa that causes the first common liquid chamber R1 and the nozzle Na to communicate with each other is composed of the first flow path Qa1, the communication flow path Qa21, the pressure chamber Ca, the second flow path Qa22, the third flow path Qa3, and the fourth flow path Qa4. The second portion Pa2 of the first individual flow path Pa that causes the nozzle Na and the second common liquid chamber R2 to communicate with each other is composed of the fifth flow path Qa5 to the ninth flow path Qa9. On the other hand, the third portion Pb3 of the second individual flow path Pb that causes the first common liquid chamber R1 and the nozzle Nb to communicate with each other is composed of the fifth flow path Qb5 to the ninth flow path Qb9. The fourth portion Pb4 of the second individual flow path Pb that causes the nozzle Nb and the second common liquid chamber R2 to communicate with each other is composed of the first flow path Qb1, the communication flow path Qb21, the pressure chamber Cb, the second flow path Qb22, the third flow path Qb3, and the fourth flow path Qb4.

The relationship between the flow path resistance and the inertance of each flow path is the same as in the first embodiment. For example, the inertance M1 of the first portion Pa1 is smaller than the inertance M2 of the second portion Pa2 (M1<M2), and the inertance M4 of the fourth portion Pb4 is smaller than the inertance M3 of the third portion Pb3 (M4<M3). Specifically, the flow path length L1 of the first portion Pa1 is shorter than the flow path length L2 of the second portion Pa2 (L1<L2), and the flow path length L4 of the fourth portion Pb4 is shorter than the flow path length L3 of the third portion Pb3 (L4<L3). According to the above configuration, it is possible to improve the ejection efficiency from the nozzle N by relatively reducing the ink that is not ejected from each nozzle N.

Further, the flow path resistance λa1 of the first portion Pa1 and the flow path resistance λb3 of the third portion Pb3 are substantially equal (λa1=λb3), and the flow path resistance λa2 of the second portion Pa2 and the flow path resistance λb4 of the fourth portion Pb4 are substantially equal (λa2=λb4). According to the above configuration, it is possible to reduce the error between the ejection characteristic of the nozzle Na and the ejection characteristic of the nozzle Nb. Further, the flow path resistance λa1 of the first portion Pa1 and the flow path resistance λa2 of the second portion Pa2 are substantially equal (λa1=λa2), and the flow path resistance λb3 of the third portion Pb3 and the flow path resistance λb4 of the fourth portion Pb4 are substantially equal (λb3=λb4). According to the above configuration, in the configuration in which the first individual flow path Pa and the second individual flow path Pb are symmetrically formed, it is easy to adopt a configuration in which the flow path resistance λa1 of the first portion Pa1 and the flow path resistance λb3 of the third portion Pb3 are substantially equal, and the flow path resistance λa2 of the second portion Pa2 and the flow path resistance λb4 of the fourth portion Pb4 are substantially equal. After all, also in the second embodiment, as in the first embodiment, the flow path resistance Xa of the first individual flow path Pa and the flow path resistance λb of the second individual flow path Pb are substantially equal.

Note that, the first to fourth features described above regarding the first embodiment are similarly adopted in the second embodiment. Specifically, it is as follows. The effects realized by the first to fourth features are the same as those in the first embodiment.

B1: First Feature

The first local flow path H1 in the second embodiment is a portion of the first individual flow path Pa that causes the pressure chamber Ca and the nozzle Na to communicate with each other. Specifically, as illustrated in FIG. 15, the first local flow path H1 is composed of the second flow path Qa22, the third flow path Qa3, and the fourth flow path Qa4 of the first individual flow path Pa. As understood from FIG. 15, the first local flow path H1 does not overlap the second individual flow path Pb when viewed in the Y-axis direction. Further, the pressure chamber Ca in the first individual flow path Pa does not overlap the second individual flow path Pb when viewed in the Y-axis direction.

The second local flow path H2 in the second embodiment is a portion of the first individual flow path Pa that overlaps the second individual flow path Pb when viewed in the Y-axis direction. Specifically, the second local flow path H2 is composed of the portion Qa52 of the fifth flow path Qa5 of the first individual flow path Pa. In the portion corresponding to the second local flow path H2, the individual flow path P is disposed at a high density. As illustrated in FIG. 17, the maximum width W1 of the first local flow path H1 is larger than the maximum width W2 of the second local flow path H2. Further, the maximum width W1 of the first local flow path H1 is larger than half the pitch Δ of each first individual flow path Pa.

As illustrated in FIG. 16, the third local flow path H3 in the second embodiment is composed of the second flow path Qb22, the third flow path Qb3, and the fourth flow path Qb4 of the second individual flow path Pb. The third local flow path H3 does not overlap the first individual flow path Pa when viewed in the Y-axis direction. Further, the pressure chamber Cb in the second individual flow path Pb does not overlap the first individual flow path Pa when viewed in the Y-axis direction.

The fourth local flow path H4 of the second individual flow path Pb overlapping the first individual flow path Pa when viewed in the Y-axis direction is composed of the portion Qb52 of the fifth flow path Qb5 of the second individual flow path Pb as illustrated in FIG. 16. In the portion corresponding to the fourth local flow path H4, the individual flow path P is disposed at a high density.

B2: Second Feature

As understood from FIG. 15, the seventh flow path Qa7 of the first individual flow path Pa overlaps the nozzle Nb communicating with the second individual flow path Pb, when viewed in the Y-axis direction. Specifically, the seventh flow path Qa7 overlaps the second section n2 of the nozzle Nb. Similarly, as understood from FIG. 16, the seventh flow path Qb7 of the second individual flow path Pb overlaps the nozzle Na communicating with the first individual flow path Pa when viewed in the Y-axis direction. Specifically, the seventh flow path Qb7 overlaps the second section n2 of the nozzle Na. Similar to the first embodiment, the seventh flow path Qa7 of the first individual flow path Pa and the seventh flow path Qb7 of the second individual flow path Pb are installed on the common nozzle plate 31 together with the nozzle Na and the nozzle Nb. Note that, the seventh flow path Qa7 is an example of the "fifth local flow path", and the seventh flow path Qb7 is an example of the "sixth local flow path".

B3: Third Feature

As illustrated in FIG. 15, the first individual flow path Pa includes a first partial flow path Ga composed of the fifth flow path Qa5, the sixth flow path Qa6, and the seventh flow path Qa7. Each of the fifth flow path Qa5 and the seventh flow path Qa7 extends along the X axis. The seventh flow path Qa7 is an example of the "seventh local flow path", the sixth flow path Qa6 is an example of the "ninth local flow path", and the fifth flow path Qa5 is an example of the "eighth local flow path".

Similarly, as illustrated in FIG. 16, the second individual flow path Pb includes a second partial flow path Gb composed of the fifth flow path Qb5, the sixth flow path Qb6, and the seventh flow path Qb7. Each of the fifth flow path Qb5 and the seventh flow path Qb7 extends along the X axis. Note that, the seventh flow path Qb7 is an example of a "tenth local flow path", the sixth flow path Qb6 is an example of a "twelfth local flow path", and the fifth flow path Qb5 is an example of an "eleventh local flow path".

As understood from FIGS. 15 and 16, the first partial flow path Ga and the second partial flow path Gb do not partially overlap when viewed in the Y-axis direction. That is, the first partial flow path Ga and the second partial flow path Gb partially overlap when viewed in the Y-axis direction. Specifically, a portion of the fifth flow path Qa5 of the first partial flow path Ga (portion Qa52) and a portion of the fifth flow path Qb5 of the second partial flow path Gb (portion Qb52) overlap in the Y-axis direction, and the other portions of the first partial flow path Ga and the other portions of the second partial flow path Gb do not overlap when viewed in the Y-axis direction. Further, the sixth flow path Qa6 of the first partial flow path Ga and the sixth flow path Qb6 of the second partial flow path Gb do not overlap when viewed in the Y-axis direction.

The fifth flow path Qa5 positioned in the upper layer of the first individual flow path Pa is closer to the first common liquid chamber R1 than the sixth flow path Qa6 and the seventh flow path Qa7, with respect to the direction of the streamline axis in the first individual flow path Pa. Further, the seventh flow path Qb7 positioned in the lower layer of the second individual flow path Pb is closer to the first common liquid chamber R1 than the fifth flow path Qb5 and the sixth flow path Qb6, with respect to the direction of the streamline axis in the second individual flow path Pb.

B4: Fourth Feature

As understood from FIG. 17, the first individual flow path Pa includes an overlapping flow path that partially overlaps the second individual flow path Pb in plan view from the Z-axis direction, and a non-overlapping flow path that does not overlap the second individual flow path Pb in plan view from the Z-axis direction. The overlapping flow path is an example of the "thirteenth local flow path", and the non-overlapping flow path is an example of the "fourteenth local flow path".

The overlapping flow path include the pressure chamber Ca, the third flow path Qa3, the portion Qa51 of the fifth flow path Qa5, the portions Qa72 to Qa73 of the seventh flow path Qa7, and the ninth flow path Qa9 of the first individual flow path Pa. The overlapping flow path does not overlap the second individual flow path Pb when viewed in the Y-axis direction.

On the other hand, the non-overlapping flow path includes the second flow path Qa22, the fourth flow path Qa4, the portions Qa52 of the fifth flow path Qa5, the sixth flow path Qa6, the portion Qa71 of the seventh flow path Qa7, and the eighth flow path Qa8 of the first individual flow path Pa. Since the non-overlapping flow path does not overlap the second individual flow path Pb in plan view, the non-overlapping flow path is allowed to overlap the second individual flow path Pb when viewed in the Y-axis direction. For example, the portion Qa52 of the fifth flow path Qa5 of the non-overlapping flow path overlaps the second individual flow path Pb when viewed in the Y-axis direction.

C: Modification Example

The embodiment exemplified above may be variously modified. A specific mode of modification that can be applied to the above-described embodiment is exemplified below. Two or more modes optionally selected from the following examples can be appropriately merged within a range not inconsistent with each other.

Figure 18:
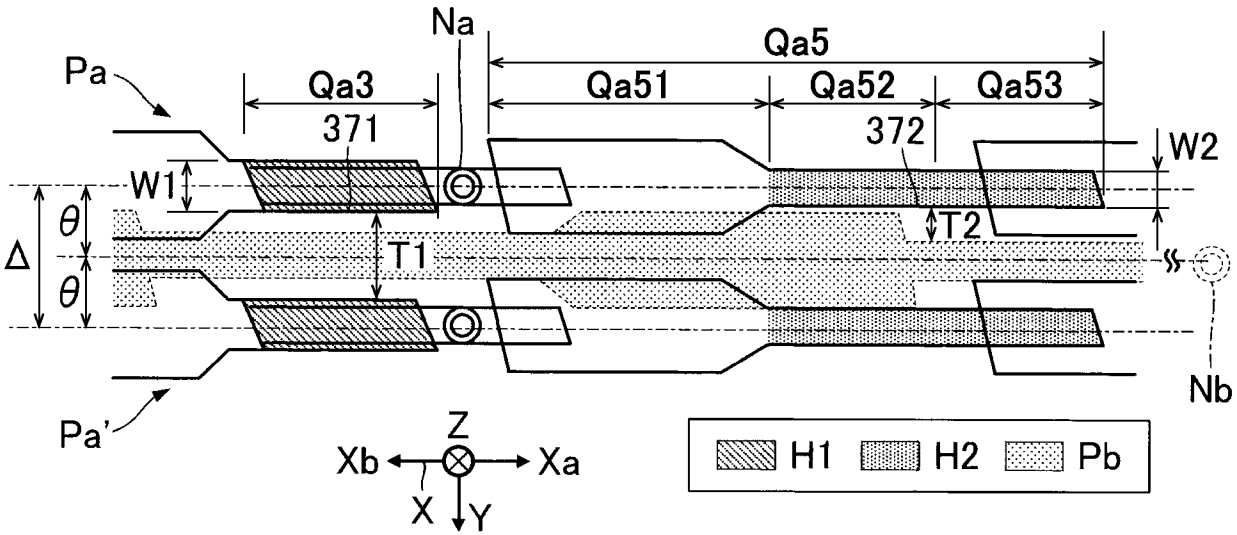
FIG. 18 is a plan view of a first local flow path and a second local flow path in a modification example.

1. In each of the above-described embodiments, a configuration in which the maximum width W1 of the first local flow path H1 is larger than the maximum width W2 of the second local flow path H2 has been exemplified. In the configuration in which the first local flow path H1 is disposed at a low density, the thickness of the side wall defining the first local flow path H1 may be secured instead of securing the maximum width W1 of the first local flow paths H1. FIG. 18 is an enlarged plan view of the first local flow path H1 and the second local flow path H2 in Modification Example 1. As illustrated in FIG. 18, the maximum width W1 of the first local flow path H1 is set to be substantially equal to the maximum width W2 of the second local flow path H2.

FIG. 18 illustrates a first side wall 371 defining a first local flow path H1 and a second side wall 372 defining a second local flow path H2. The first side wall 371 is a side wall configuring the wall surface positioned in the Y-axis direction among the inner wall surfaces of the first local flow path H1. That is, the first side wall 371 is a partition wall that partitions between the two first local flow paths H1 adjacent to each other in the Y-axis direction. Similarly, the second side wall 372 is a side wall configuring the wall surface positioned in the Y-axis direction among the inner wall surfaces of the second local flow path H2. The second local flow path H2 overlaps the second individual flow path Pb when viewed in the Y-axis direction. Therefore, the second side wall 372 is a partition wall that partitions between the second local flow path H2 of the first individual flow path Pa and the second individual flow path Pb.

FIG. 18 illustrates a maximum width T1 of the first side wall 371 and a maximum width T2 of the second side wall 372. The maximum width T1 is a maximum value of a dimension (that is, the width) of the first side wall 371 in the Y-axis direction. The maximum width T2 is a maximum value of a dimension of the second side wall 372 in the Y-axis direction. As understood from FIG. 18, the maximum width T1 of the first side wall 371 is larger than the maximum width T2 of the second side wall 372 (T1>T2). As described above, according to the configuration in which the maximum width T1 of the first side wall 371 exceeds the maximum width T2 of the second side wall 372, the cross-talk between the first local flow paths H1 can be effectively reduced.

Note that, in FIG. 18, the maximum width W1 of the first local flow path H1 and the maximum width W2 of the second local flow path H2 are set to be substantially equal, but a configuration in which the maximum width W1 exceeds the maximum width W2 and the maximum width T1 of the first side wall 371 exceeds the maximum width T2 of the second side wall 372 is also assumed.

2. In each of the above-described embodiments, a configuration in which the first partial flow path Ga and the second partial flow path Gb partially overlap is exemplified, but a configuration in which the entire first partial flow path Ga and the entire second partial flow path Gb do not overlap in the Y-axis direction is also adopted. According to the above configuration, the first partial flow path Ga and the second partial flow path Gb can be disposed at a low density in the Y-axis direction.

3. In each of the above-described embodiments, a configuration in which the ink is circulated from the second common liquid chamber R2 to the first common liquid chamber R1 is illustrated, but the ink circulation is not essential in the present disclosure. Therefore, the second common liquid chamber R2 and the circulation mechanism 26 may be omitted.

4. The energy generating element that changes the pressure of the ink in the pressure chamber C is not limited to the piezoelectric element 41 exemplified in the above-described embodiment. For example, a heating element that fluctuates the pressure of the ink by generating bubbles inside the pressure chamber C by heating may be used as the energy generating element. In the configuration in which the heating element is used as the energy generating element, the range of the individual flow path P where the bubbles are generated by heating by the heating element is defined as the pressure chamber Ca.

5. In the above-described embodiment, a serial type liquid ejecting system 100 in which the transport body 231 equipped with the liquid ejecting head 24 is reciprocated has been exemplified, but the present disclosure is also applied to a line type liquid ejecting system in which a plurality of nozzles N are distributed over the entire width of the medium 11.

6. The liquid ejecting system 100 exemplified in the above-described embodiment can be adopted not only in a device dedicated to printing but also in various devices such as a facsimile machine and a copying machine. However, the application of the liquid ejecting system of the present disclosure is not limited to printing. For example, a liquid ejecting system that ejects a solution of a coloring material is used as a manufacturing apparatus that forms a color filter of a display apparatus such as a liquid crystal display panel. Further, a liquid ejecting system that ejects a solution of a conductive material is used as a manufacturing apparatus that forms wiring and electrodes of a wiring substrate. Moreover, a liquid ejecting system that ejects a solution of an organic substance relating to a living body is used, for example, as a manufacturing apparatus for manufacturing a biochip.

D: Appendix

The following configurations can be grasped from the embodiments exemplified above, for example.

Note that, in the present application, for example, the notation of "nth" (n is a natural number) such as "first" and "second" is used only as a formal and convenient sign (label) for distinguishing each element in the notation, and does not have any substantial meaning. That is, the magnitude or order of a numerical value n in the notation "nth" does not affect the interpretation of each element. For example, the notations of the "first" element and the "second" element do not mean the position of each element or the order of manufacturing. Therefore, for example, there is no limitative interpretation that the "first" element is positioned in front of the "second" element, and there is no limitative interpretation that the "first" element is manufactured prior to the "second" element. In addition, as described above, the notation of "nth" is merely a formal and convenient sign, and therefore, whether or not there is continuity of the numerical value n over a plurality of elements does not matter. For example, even when the "second element" appears in a situation where the "first element" does not appear, there is no problem and the interpretation of each element is not affected. Also, for example, when the numerical value n of the "nth" element is changed, or when the "first" and the "second" are exchanged between the "first" element and the "second element", the interpretation of each element is not affected.

In addition, the "overlapping" of the element A and the element B when viewed in a specific direction means that at least a portion of the element A and at least a portion of the element B overlap each other when viewed along the direction. It is not necessary that all of the element A and all of the element B overlap, and when at least a portion of the element A and at least a portion of the element B overlap, it is interpreted as "the element A and the element B overlap".

D1: Mode A

According to one mode (mode A1) of the present disclosure, there is provided a liquid ejecting head including: a plurality of individual flow paths, each of which has a pressure chamber and communicates with a nozzle that ejects a liquid in a first axis direction; and a first common liquid chamber coupled to the plurality of individual flow paths, in which when viewed in the first axis direction, the plurality of individual flow paths are arranged in parallel along a second axis direction orthogonal to a first axis to form an individual flow path row, when two individual flow paths adjacent to each other in the individual flow path row are assumed to be a first individual flow path and a second individual flow path, the first individual flow path includes a first local flow path that causes the pressure chamber and the nozzle to communicate with each other, and the first local flow path does not overlap the second individual flow path when viewed in the second axis direction.

In the above mode, the first local flow path of the first individual flow path does not overlap the second individual flow path when viewed in the second axis direction. Therefore, as compared with the configuration in which the first local flow path overlaps the second individual flow path when viewed in the second axis direction, the first local flow paths can be installed at a low density in the second axis direction. According to the configuration in which the flow path is disposed at a low density as described above, for example, there is an advantage that the flow path resistance or the inertance is reduced by securing the flow path width, or that the crosstalk is reduced by securing the wall thickness between the flow paths. Since the first local flow path that causes the pressure chamber and the nozzle to communicate with each other is a flow path that has a large effect on the ejection characteristic of the liquid by the nozzle, the configuration in which the first local flow path is disposed at a low density is particularly effective.

In a specific example (mode A2) of mode A1, the pressure chamber in the first individual flow path does not overlap the second individual flow path when viewed in the second axis direction. According to the above mode, the pressure chamber can be disposed at a low density in the second axis direction as compared with the configuration in which the pressure chambers in the first individual flow path overlap the second individual flow path when viewed in the second axis direction.

In a specific example (mode A3) of mode A1 or mode A2, the first individual flow path includes a second local flow path that overlaps the second individual flow path when viewed in the second axis direction. In the above mode, the second local flow path is disposed at a high density along the second axis. Therefore, the space for forming the flow path can be efficiently used.

In a specific example (mode A4) of mode A3, a maximum width of the first local flow path is larger than a maximum width of the second local flow path. According to the above mode, the flow path width of the first local flow path is sufficiently secured. Therefore, the flow path resistance of the first local flow path can be effectively reduced. The width of the individual flow path means a dimension of the flow path in the second axis direction.

In a specific example (mode A5) of mode A3 or mode A4, a first side wall defining the first local flow path and a second side wall defining the second local flow path are included, and a maximum width of the first side wall is larger than a maximum width of the second side wall. According to the above mode, the wall thickness of the side wall that defines the first local flow path is sufficiently secured. Therefore, the crosstalk in the first local flow path can be effectively reduced. Note that, the width of the side wall means a dimension of the side wall in the second axis direction.

In a specific example (mode A6) of any one of modes A1 to A5, the individual flow path row includes a third individual flow path adjacent to the second individual flow path and different from the first individual flow path, and a maximum width of the first local flow path is larger than half a pitch between the first individual flow path and the third individual flow path. According to the above mode, since the flow path width of the first local flow path is sufficiently secured, the flow path resistance of the first local flow path can be effectively reduced.

In a specific example (mode A7) of any one of modes A1 to A6, the first local flow path partially overlaps the second individual flow path when viewed in the first axis direction. According to the above mode, the flow path width of the first local flow path is sufficiently secured as compared with the configuration in which the first local flow path does not overlap the second individual flow path when viewed in the first axis direction. Therefore, the flow path resistance of the first local flow path can be effectively reduced.

In a specific example (mode A8) of any one of modes A1 to A7, the second individual flow path includes a third local flow path that causes the pressure chamber and the nozzle to communicate with each other, and the third local flow path does not overlap the first individual flow path when viewed in the second axis direction. In the above mode, the third local flow path can be disposed at a low density in the second axis direction as compared with the configuration in which the third local flow path overlaps the first individual flow path when viewed in the second axis direction.

In a specific example (mode A9) of mode A8, the pressure chamber in the second individual flow path does not overlap the first individual flow path when viewed in the second axis direction. According to the above mode, the pressure chamber can be disposed at a low density in the second axis direction as compared with the configuration in which the pressure chamber of the second individual flow path overlaps the first individual flow path when viewed in the second axis direction.

In a specific example (mode A10) of any one of modes A1 to A9, the second individual flow path includes a fourth local flow path that overlaps the first individual flow path when viewed in the second axis direction. In the above mode, the fourth local flow path is disposed at a high density in the second axis direction. Therefore, the space for forming the flow path can be efficiently used.

D2: Mode B

According to one mode (mode B1) of the present disclosure, there is provided a liquid ejecting head including: a plurality of individual flow paths, each of which has a pressure chamber and communicates with a nozzle that ejects a liquid in a first axis direction; and a first common liquid chamber coupled to the plurality of individual flow paths, in which when viewed in the first axis direction, the plurality of individual flow paths are arranged in parallel along a second axis direction orthogonal to a first axis to form an individual flow path row, and when two individual flow paths adjacent to each other in the individual flow path row are assumed to be a first individual flow path and a second individual flow path, the first individual flow path includes a fifth local flow path that overlaps the nozzle communicating with the second individual flow path when viewed in the second axis direction.

According to the above mode, the fifth local flow path of the first individual flow path and the nozzle communicating with the second individual flow path overlap when viewed in the second axis direction. Therefore, the fifth local flow path can be disposed at a low density in the second axis direction. According to the configuration in which the flow path is disposed at a low density as described above, for example, there is an advantage that the flow path resistance or the inertance is reduced by securing the flow path width, or that the crosstalk is reduced by securing the wall thickness between the flow paths. Since the nozzle generally has a smaller diameter than the individual flow path, an occupying width of the nozzle in the second axis direction is small. Therefore, a degree of freedom in designing the flow path width and the wall thickness of the fifth local flow path does not excessively decrease.

In a specific example (mode B2) of mode B1, the nozzle has a first section including an opening through which a liquid is ejected, and a second section positioned between the first section and the individual flow path, the second section has a larger diameter than the first section, and the fifth local flow path overlaps the second section of the nozzle communicating with the second individual flow path and does not overlap the first section of the nozzle when viewed in the second axis direction. According to the above mode, it is possible to collectively form the fifth local flow path and the second section by the step of removing a portion of a substrate in a thickness direction.

In a specific example (mode B3) of the mode B1 or B2, the nozzle communicating with the first individual flow path and the nozzle communicating with the second individual flow path do not overlap when viewed in the second axis direction. According to the above mode, the space for forming the flow path and the nozzle can be efficiently used.

In a specific example (mode B4) of any one of modes B1 to B3, the fifth local flow path and the nozzle communicating with the second individual flow path are provided on a common substrate. According to the above configuration, the fifth local flow path and the nozzle communicating with the second individual flow path are provided on the common substrate. Therefore, the configuration of the liquid ejecting head is simplified as compared with the configuration in which the fifth local flow path and the nozzle communicating with the second individual flow path are provided on a separate substrate.

In a specific example (mode B5) of mode B4, the second individual flow path includes a sixth local flow path provided on the substrate, and the sixth local flow path and the nozzle communicating with the second individual flow path do not directly communicate with each other in the substrate. In the configuration in which the sixth local flow path and the nozzle communicating with the second individual flow path directly communicate with each other in the substrate, the fifth local flow path and the sixth local flow path are adjacent to each other at a high density in the substrate. On the other hand, according to the configuration in which the sixth local flow path and the nozzle communicating with the second individual flow path do not directly communicate with each other in the substrate, the fifth local flow path and the sixth local flow path can be disposed at a low density in the second axis direction. In addition, the fact that the sixth local flow path and the nozzle communicating with the second individual flow path "do not directly communicate with each other in the substrate" means that a groove or a recess that causes the sixth local flow path and the nozzle communicating with the second individual flow path to communicate with each other is not formed on a surface or an inside of the substrate.

In a specific example (mode B6) of any one of modes B1 to B4, the second individual flow path includes a sixth local flow path that overlaps the nozzle communicating with the first individual flow path when viewed in the second axis direction. According to the above mode, since the sixth local flow path of the second individual flow path and the nozzle communicating with the first individual flow path overlap in the second axis direction, the space for forming the flow path can be efficiently used.

D3: Mode C

According to one mode (mode C1) of the present disclosure, there is provided a liquid ejecting head including: a plurality of individual flow paths, each of which has a pressure chamber and communicates with a nozzle that ejects a liquid in a first axis direction, and a first common liquid chamber coupled to the plurality of individual flow paths, in which when viewed in the first axis direction, the plurality of individual flow paths are arranged in parallel along a second axis direction orthogonal to a first axis to form an individual flow path row, and when two individual flow paths adjacent to each other in the individual flow path row are assumed to be a first individual flow path and a second individual flow path, the first individual flow path includes a first partial flow path, and the second individual flow path includes a second partial flow path, the first partial flow path includes a seventh local flow path and an eighth local flow path that extend in a direction orthogonal to the first axis, and a ninth local flow path that causes the seventh local flow path and the eighth local flow path to communicate with each other, the seventh local flow path is in a layer closer to an ejecting surface of the nozzle than the eighth local flow path, and the second partial flow path includes a tenth local flow path and an eleventh local flow path that extend in a direction orthogonal to the first axis, and a twelfth local flow path that causes the tenth local flow path and the eleventh local flow path to communicate with each other, the tenth local flow path is in a layer closer to the ejecting surface of the nozzle than the eleventh local flow path, and at least portions of the first partial flow path and the second partial flow path do not overlap when viewed in the second axis direction.

In the above mode, portions of the first partial flow path and the second partial flow path that do not overlap when viewed in the second axis direction can be disposed at a low density in the second axis direction. According to the configuration in which the flow path is disposed at a low density as described above, for example, there is an advantage that the flow path resistance or the inertance is reduced by securing the flow path width, or that the crosstalk is reduced by securing the wall thickness between the flow paths. In addition, the configuration in which at least the portions of the first partial flow path and the second partial flow path "do not overlap when viewed in the second axis direction" includes a configuration in which portions of the first partial flow path and the second partial flow path overlap and other portions of the first partial flow path and the second partial flow path do not overlap, and a configuration in which the first partial flow path and the second partial flow path do not overlap at all.

In a specific example (mode C2) of the mode C1, the eighth local flow path is closer to the first common liquid chamber than the seventh local flow path with respect to a direction of a streamline axis in the first individual flow path, and the tenth local flow path is closer to the first common liquid chamber than the eleventh local flow path with respect to a direction of a streamline axis in the second individual flow path. In the above mode, the eighth local flow path in the first individual flow path is closer to the first common liquid chamber than the seventh local flow path in a layer closer to a ejecting surface than the eighth local flow path, and the tenth local flow path of the second individual flow path is closer to the first common liquid chamber than the eleventh local flow path in a layer farther from the ejecting surface than the tenth local flow path. According to the above configuration, the space for forming the flow path can be efficiently used.

In a specific example (mode C3) of mode C1 or C2, the seventh local flow path, the tenth local flow path, and the nozzle are provided on a common substrate. According to the above configuration, the seventh local flow path, the tenth local flow path, and the nozzle are provided on the common substrate. Therefore, the configuration of the liquid ejecting head can be simplified as compared with the configuration in which the seventh local flow path and the tenth local flow path are provided on a separate substrate from the nozzle.

In a specific example (mode C4) of mode C3, the seventh local flow path and the tenth local flow path do not overlap when viewed in the second axis direction. It is difficult to secure a sufficient thickness for the substrate on which the nozzle is formed. When the seventh local flow path and the tenth local flow path overlap when viewed in the second axis direction in a case where the substrate is sufficiently thin as described above, it is difficult to secure a sufficient flow path cross-sectional area for the seventh local flow path and the tenth local flow path. According to the above-described configuration in which the seventh local flow path and the tenth local flow path do not overlap when viewed in the second axis direction, the seventh local flow path and the tenth local flow path can be disposed at a low density in the second axis direction. Therefore, for example, even in a configuration in which the substrate is sufficiently thin, there is an advantage that the flow path cross-sectional areas of the seventh local flow path and the tenth local flow path can be easily secured.

In a specific example (mode C5) of mode C4, the seventh local flow path and the eleventh local flow path do not overlap when viewed in the second axis direction.

In a specific example (mode C6) of mode C5, the eighth local flow path and the tenth local flow path do not overlap when viewed in the second axis direction.

In a specific example (mode C7) of any one of modes C1 to C6, the seventh local flow path overlaps the nozzle communicating with the second individual flow path when viewed in the second axis direction. In the above mode, the seventh local flow path of the first individual flow path and the nozzle communicating with the second individual flow path overlap when viewed in the second axis direction. Therefore, the seventh local flow path can be disposed at a low density in the second axis direction.

In a specific example (mode C8) of any one of modes C1 to C7, the tenth local flow path overlaps the nozzle communicating with the first individual flow path when viewed in the second axis direction. In the above mode, the tenth local flow path of the second individual flow path and the nozzle communicating with the first individual flow path overlap when viewed in the second axis direction. Therefore, the tenth local flow path can be disposed at a low density in the second axis direction.

In a specific example (mode C9) of any one of modes C1 to C8, the ninth local flow path and the twelfth local flow path do not overlap when viewed in the second axis direction. In the configuration in which the ninth local flow path and the twelfth local flow path overlap when viewed in the second axis direction, partial overlap between the seventh local flow path and the tenth local flow path and partial overlap between the eighth local flow path and the eleventh local flow path occur. Therefore, a ratio of the sections of the individual flow path which is disposed at a high density in the second axis direction increases. According to the configuration in which the ninth local flow path and the twelfth local flow path do not overlap when viewed in the second axis direction, it is possible to reduce the ratio of the sections of the individual flow path which is disposed at a high density.

In a specific example (mode C10) of any one of modes C1 to C8, the ninth local flow path and the twelfth local flow path overlap when viewed in the second axis direction. In the configuration in which the ninth local flow path and the twelfth local flow path do not overlap when viewed in the second axis direction, since the range in which the ninth local flow path and the twelfth local flow path are formed is restricted, the flow path width of each of the ninth local flow path and the twelfth local flow path is limited. According to the configuration in which the ninth local flow path and the twelfth local flow path overlap when viewed in the second axis direction, since the restriction relating to the ninth local flow path and the twelfth local flow path is relaxed, it is possible to properly secure the flow path widths of the ninth local flow path and the twelfth local flow path.

In a specific example (mode C11) of any one of modes C1 to C10, at least portions of the first partial flow path and the second partial flow path overlap when viewed in the second axis direction.

D4: Mode D

According to one mode (mode D1) of the present disclosure, there is provided a liquid ejecting head including: a plurality of individual flow paths, each of which has a pressure chamber and communicates with a nozzle that ejects a liquid in a first axis direction, and a first common liquid chamber coupled to the plurality of individual flow paths, in which when viewed in the first axis direction, the plurality of individual flow paths are arranged in parallel along a second axis direction orthogonal to a first axis to form an individual flow path row, and when two individual flow paths adjacent to each other in the individual flow path row are assumed to be a first individual flow path and a second individual flow path, the first individual flow path includes a thirteenth local flow path that partially overlaps the second individual flow path when viewed in the first axis direction.

In the above mode, the first individual flow path includes the thirteenth local flow path that partially overlaps the second individual flow path when viewed in the first axis direction. That is, the flow path width of the first individual flow path or the flow path width of the second individual flow path is widened beyond the interference limit between the flow paths. Therefore, there is an advantage that the flow path resistance or the inertance of the individual flow path row is reduced.

In a specific example (mode D2) of mode D1, the thirteenth local flow path does not overlap the second individual flow path when viewed in the second axis direction.

In a specific example (mode D3) of mode D1 or D2, the thirteenth local flow path includes at least a portion of the pressure chamber in the first individual flow path. Further, since the pressure chamber is widened so as to overlap the second individual flow path when viewed in the first axis direction, the excluded volume of the pressure chamber is increased as compared with the configuration in which the pressure chamber does not overlap the second individual flow path. Therefore, an excellent ink ejection characteristic is realized.

In a specific example (mode D4) of any one of modes D1 to D3, the first individual flow path includes a fourteenth local flow path that overlaps the second individual flow path when viewed in the second axis direction. In the above mode, the fourteenth local flow path is disposed at a high density along the second axis. Therefore, the space for forming the flow path can be efficiently used.

In a specific example (mode D5) of mode D4, a maximum width of the thirteenth local flow path is larger than a maximum width of the fourteenth local flow path. According to the above mode, the flow path width of the thirteenth local flow path is sufficiently secured. Therefore, the flow path resistance of the thirteenth local flow path can be effectively reduced.

In a specific example (mode D6) of any one of modes D1 to D5, the individual flow path row includes a third individual flow path that is adjacent to the second individual flow path and is different from the first individual flow path, and a maximum width of the thirteenth local flow path is larger than half a pitch between the first individual flow path and the third individual flow path.

In a specific example (mode D7) of any one of modes D1 to D6, the second individual flow path includes a fifteenth local flow path that partially overlaps the first individual flow path when viewed in the first axis direction. In the above mode, the second individual flow path includes the fifteenth local flow path that partially overlaps the first individual flow path when viewed in the first axis direction. Therefore, as compared with the configuration in which the second individual flow path does not overlap the first individual flow path when viewed in the first axis direction, the second individual flow path can be installed at a low density in the second axis direction.

In a specific example (mode D8) of mode D7, the fifteenth local flow path includes at least a portion of the pressure chamber in the second individual flow path. In the above mode, since the pressure chamber is widened so as to overlap the second individual flow path when viewed in the first axis direction, the excluded volume of the pressure chamber is increased as compared with the configuration in which the pressure chamber does not overlap the second individual flow path. Therefore, an excellent ink ejection characteristic is realized.

D5: Other Modes

According to a specific example (mode E1) of any mode exemplified above, the liquid ejecting head further includes a second common liquid chamber that stores a liquid, ends of the plurality of individual flow paths opposite to ends coupled to the first common liquid chamber are coupled to the second common liquid chamber, the first individual flow path has a first portion between the first common liquid chamber and the nozzle communicating with the first individual flow path, and a second portion between the nozzle and the second common liquid chamber, and the second individual flow path has a third portion between the first common liquid chamber and the nozzle communicating with the second individual flow path, and a fourth portion between the nozzle and the second common liquid chamber. In the above mode, out of the liquid supplied from one of the first common liquid chamber and the second common liquid chamber to the plurality of individual flow paths, the liquid that is not ejected from the nozzle is supplied to the other of the first common liquid chamber and the second common liquid chamber. Therefore, it is possible to circulate the liquid.

In a specific example (mode E2) of mode E1, the first portion includes the pressure chamber in the first individual flow path, and the fourth portion includes the pressure chamber in the second individual flow path. In the above mode, the pressure chamber is installed in a position close to the first common liquid chamber in the first individual flow path, and the pressure chamber is installed in a position close to the second common liquid chamber in the second individual flow path. Therefore, the pressure chamber can be disposed at a low density in the second axis direction.

In a specific example (mode E3) of mode E2, an inertance of the first portion is smaller than an inertance of the second portion, and an inertance of the fourth portion is smaller than an inertance of the third portion. According to the above configuration, it is possible to improve a liquid ejection efficiency.

In a specific example (mode E4) of mode E3, a flow path length of the first portion is shorter than a flow path length of the second portion, and a flow path length of the fourth portion is shorter than a flow path length of the third portion.

In a specific example (mode E5) of any one of modes E1 to E4, a flow path resistance of the first portion and a flow path resistance of the second portion are substantially equal. According to the above configuration, it is possible to reduce an error in the ejection characteristic between a case where the ink is supplied from the first portion to the nozzle and a case where the ink is supplied from the second portion to the nozzle.

In a specific example (mode E6) of any one of modes E1 to E5, a flow path resistance of the first portion and a flow path resistance of the third portion are substantially equal. According to the above configuration, it is possible to reduce an error in the ejection characteristic between the nozzle communicating with the first individual flow path and the nozzle communicating with the second individual flow path.

In a specific example (mode E7) of mode E5 or E6, the first portion includes a communication flow path having a flow path cross-sectional area smaller than a minimum flow path cross-sectional area of the second portion.

In a specific example (mode E8) of mode E7, the communication flow path is positioned between the pressure chamber of the first individual flow path and the first common liquid chamber.

According to one mode (mode E9) of the present disclosure, there is provided a liquid ejecting system including: the liquid ejecting head according to any one of the above-described modes, and a circulation mechanism that causes the liquid discharged from the plurality of individual flow paths to the second common liquid chamber to recirculate to the first common liquid chamber.

What is claimed is:

1. A liquid ejecting head comprising:

a plurality of individual flow paths, each of which has a pressure chamber and communicates with a nozzle that ejects a liquid in a first axis direction; and a first common liquid chamber coupled to the plurality of individual flow paths, wherein when viewed in the first axis direction, the plurality of individual flow paths are arranged in parallel along a second axis direction orthogonal to a first axis to form an individual flow path row, when two individual flow paths adjacent to each other in the individual flow path row are assumed to be a first individual flow path and a second individual flow path, the first individual flow path includes a first local flow path that causes the pressure chamber and the nozzle to communicate with each other and a second local flow path, the second individual flow path includes a third local flow path that causes the pressure chamber and the nozzle to communicate with each other and a fourth local flow path, the first local flow path does not overlap the second individual flow path when viewed in the second axis direction, the second local flow path overlaps the second individual flow path when viewed in the second axis direction the third local flow path does not overlap the first individual flow path when viewed in the second axis direction, the fourth local flow path overlaps the first individual flow path when viewed in the second axis direction, the pressure chamber in the first individual flow path does not overlap the second individual flow path when viewed in the second axis direction, and the pressure chamber in the second individual flow path does not overlap the first individual flow path when viewed in the second axis direction.

2. The liquid ejecting head according to claim 1, wherein
a maximum width of the first local flow path is larger than a maximum width of the second local flow path.

3. The liquid ejecting head according to claim 1, further comprising:
a first side wall defining the first local flow path; and
a second side wall defining the second local flow path, wherein
a maximum width of the first side wall is larger than a maximum width of the second side wall.

4. The liquid ejecting head according to claim 1, wherein
the individual flow path row includes a third individual flow path that is adjacent to the second individual flow path and is different from the first individual flow path, and
a maximum width of the first local flow path is larger than half a pitch between the first individual flow path and the third individual flow path.

5. The liquid ejecting head according to claim 1, wherein
the first local flow path partially overlaps the second individual flow path when viewed in the first axis direction.

6. A liquid ejecting head comprising:
a plurality of individual flow paths, each of which has a pressure chamber and communicates with a nozzle that ejects a liquid in a first axis direction;
a first common liquid chamber coupled to the plurality of individual flow paths; and
a second common liquid chamber that stores a liquid, wherein
when viewed in the first axis direction, the plurality of individual flow paths are arranged in parallel along a second axis direction orthogonal to a first axis to form an individual flow path row,
when two individual flow paths adjacent to each other in the individual flow path row are assumed to be a first individual flow path and a second individual flow path,
the first individual flow path includes a first local flow path that causes the pressure chamber and the nozzle to communicate with each other,
the first local flow path does not overlap the second individual flow path when viewed in the second axis direction,
ends of the plurality of individual flow paths opposite to ends coupled to the first common liquid chamber are coupled to the second common liquid chamber,
the first individual flow path has
a first portion between the first common liquid chamber and the nozzle communicating with the first individual flow path, and
a second portion between the nozzle and the second common liquid chamber, and
the second individual flow path has
a third portion between the first common liquid chamber and the nozzle communicating with the second individual flow path, and
a fourth portion between the nozzle and the second common liquid chamber.

7. The liquid ejecting head according to claim 6, wherein
the first portion has the pressure chamber in the first individual flow path, and
the fourth portion has the pressure chamber in the second individual flow path.

8. The liquid ejecting head according to claim 6, wherein
an inertance of the first portion is smaller than an inertance of the second portion, and
an inertance of the fourth portion is smaller than an inertance of the third portion.

9. The liquid ejecting head according to claim 8, wherein
a flow path length of the first portion is shorter than a flow path length of the second portion, and
a flow path length of the fourth portion is shorter than a flow path length of the third portion.

10. The liquid ejecting head according to claim 6, wherein
a flow path resistance of the first portion and a flow path resistance of the second portion are substantially equal.

11. The liquid ejecting head according to claim 6, wherein
a flow path resistance of the first portion and a flow path resistance of the third portion are substantially equal.

12. The liquid ejecting head according to claim 10, wherein
the first portion has a communication flow path having a flow path cross-sectional area smaller than a minimum flow path cross-sectional area of the second portion.

13. The liquid ejecting head according to claim 12, wherein
the communication flow path is positioned between the pressure chamber of the first individual flow path and the first common liquid chamber.

14. A liquid ejecting system comprising:
the liquid ejecting head according to claim 6; and
a circulation mechanism that causes the liquid discharged from the plurality of individual flow paths to the second common liquid chamber to recirculate to the first common liquid chamber.

* * * * *